US006394586B2

(12) United States Patent
Isshiki

(10) Patent No.: US 6,394,586 B2
(45) Date of Patent: May 28, 2002

(54) LIQUID DROPLET DISCHARGING HEAD AND INK JET RECORDING DEVICE

(75) Inventor: Kaihei Isshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/795,508

(22) Filed: Feb. 27, 2001

(30) Foreign Application Priority Data

Mar. 24, 2000 (JP) ..... 2000-083553

(51) Int. Cl.[7] ..... B41J 2/06
(52) U.S. Cl. ..... 347/54
(58) Field of Search ..... 347/54, 68, 69, 347/70, 71, 72, 50, 40, 20, 44, 47, 27, 63; 399/261; 310/328–330; 361/700; 29/890.1

(56) References Cited

FOREIGN PATENT DOCUMENTS

| | | |
|---|---|---|
| JP | 5-50601 | 3/1993 |
| JP | 6-71882 | 3/1994 |
| JP | 7246706 | 9/1995 |
| JP | 8-29056 | 2/1996 |
| JP | 11-993 | 1/1999 |

*Primary Examiner*—Raquel Yvette Gordon
(74) *Attorney, Agent, or Firm*—Cooper & Dunham LLP

(57) ABSTRACT

The present invention provides a liquid droplet discharging head which can reduce crosstalk and maintain reliability with high-density nozzles. In the liquid droplet discharging head of the present invention, the bonding portion between a substrate on which a diaphragm is disposed and a substrate on which electrodes are disposed has a width between 5 $\mu$m and 25 $\mu$m.

7 Claims, 21 Drawing Sheets

LIQUID DROPLET DISCHARGING HEAD AND INK JET RECORDING DEVICE

BACKGROUND OF THE INVENTION

1. Field of the Invention

The present invention relates to a liquid droplet discharging head and an ink jet recording device.

2. Description of the Related Art

Generally, an ink jet head is used as a liquid droplet discharging head mounted on an ink jet recording device used in an image recording apparatus, such as a printer, a facsimile machine, a copying machine, or a plotter. As such an ink jet head, an electrostatic ink jet head that discharges ink droplets through a nozzle by deforming and displacing a diaphragm with static electricity is well known. Such a conventional electrostatic ink jet head comprises the nozzle through which ink droplets are discharged, a discharging chamber (also referred to as an ink fluid passage, an ink chamber, a pressure chamber, a pressurizing chamber, or a pressuring liquid chamber) that communicates with the nozzle, a diaphragm that also serves as a first electrode which constitutes a wall surface of the discharging chamber, and a second electrode that faces the diaphragm.

Japanese Laid-Open Patent Application Nos. 6-071882 and 5-050601 disclose conventional electrostatic ink jet heads. In those electrostatic ink jet heads, a silicon substrate is used as a substrate for forming a discharging chamber and a diaphragm, and boro-silicate glass (Pyrex glass) or a silicon substrate is used as a substrate on which an electrode is disposed.

In such an ink jet head, crosstalk may occur when one discharging chamber is energized and the ink therein is pressurized, thus the ink pressure propagates to the ink in the adjacent discharging chambers, resulting in uncontrolled ink discharge. When crosstalk occurs, the quality of images obtained by the ink jet head deteriorates. Especially, crosstalk occurs more frequently, as the nozzle intervals are becoming narrower with higher density arrangement of the nozzles.

To prevent the crosstalk, Japanese Laid-Open Patent Application No. 8-029056 discloses a technique to change the rigidity of the diaphragm by gradually changing the thickness of the diaphragm. Japanese Laid-Open Patent Application No. 7-246706 discloses a technique to increase the rigidity of the discharging chamber by arranging ribs on the wall. Further, Japanese Laid-Open Patent Application No. 11-000993 discloses a technique in which the height of the liquid chamber is limited.

With the electrostatic ink jet head, there is a problem, besides the crosstalk problem, that accuracy needs to be maintained in the bonding of a substrate having the diaphragm to a substrate having the electrode, and in the minute gap between the diaphragm and the electrode.

A conventional ink jet head normally has a discharging density of approximately 128 dpi. As the recording density is increased to 1200 dpi by increasing the number of the scanning paths while using such a head, the recording rate is reduced with the larger number of scanning paths due to low discharging density of the head.

To produce an ink jet head having a discharging density of 300 dpi or higher, the pitch between adjacent bits has to be set to approximately 85 $\mu$m. Since the width of the diaphragm for discharging needs to be approximately 60 $\mu$m, the partition wall between the bits has to be approximately 25 $\mu$m. Depending on the performance of actuators, a wider diaphragm is required. If excellent discharging characteristics are desired, the width of the partition walls has to be reduced. In such an ink jet head, the electrode for driving the diaphragm faces the diaphragm, resulting in even narrower pitch between adjacent bits. With such an ink jet head, there is a problem of poor substrate bonding, besides the crosstalk problem.

In the above high-density ink jet head, it is very difficult to vary the thickness of the diaphragm so as to reduce the crosstalk, or form ribs on the partition wall. The technique of limiting the height of the liquid chamber is not a very practical method, because it is necessary to change the height of the liquid chamber depending on the pitch of the nozzles.

To solve the above problems, the inventors have made intensive studies on an ink jet head that can ensure reliability in bonding of the substrate having the diaphragm to the substrate having the electrode, and can reduce crosstalk.

SUMMARY OF THE INVENTION

It is a general object of the present invention to provide liquid droplet discharging heads and ink jet recording devices in which the above-mentioned problems are eliminated.

A more specific object of the present invention is to provide a high-density liquid droplet discharging head that can reduce crosstalk and attain reliability in bonding, and an ink jet recording device that can perform a high-quality recording operation with the high-density liquid droplet discharging head.

The above objects of the present invention are achieved by a liquid droplet discharging head in which the width of the bonding portion between a diaphragm substrate and an electrode substrate is in a range of 5 $\mu$m to 25 $\mu$m.

In a case where the diaphragm substrate and the electrode substrate are both silicon substrates in this liquid droplet discharging head, the two substrates can be bonded directly to each other. In a case where the diaphragm substrate is a silicon substrate, and the electrode substrate is a glass substrate, the two substrates can be bonded to each other by anode bonding. The width of each partition wall between the discharging chambers should preferably be narrower than the width of each partition wall between the electrodes.

Also, it is preferred that the electrodes are not in parallel with the diaphragm in the width direction of the diaphragm. Further, the discharging density should preferably be 300 dpi or higher.

The above objects of the present invention are also achieved by an ink jet recording device on which the liquid droplet discharging head of the present invention is mounted.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1:
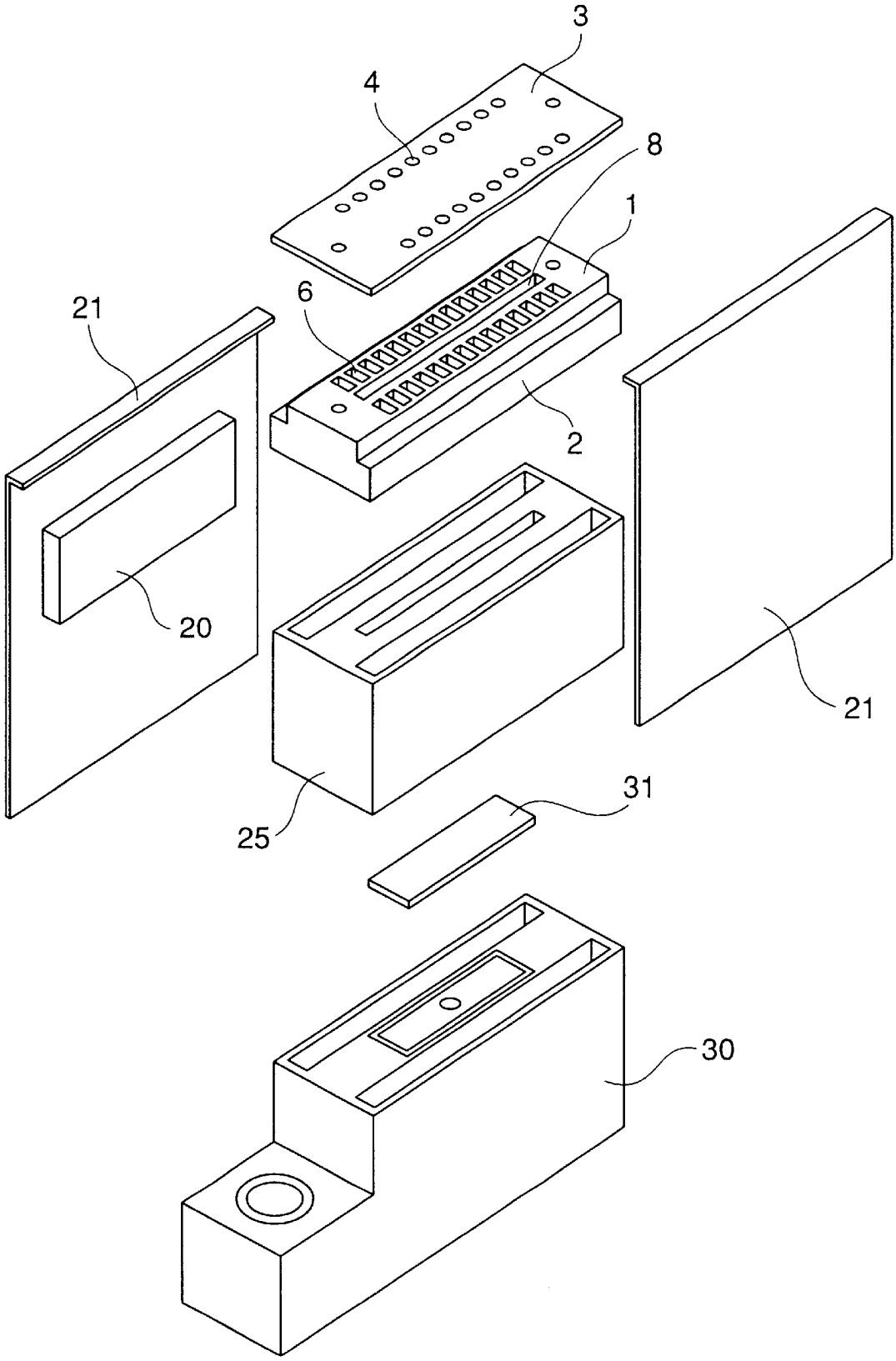
FIG. 1 is an exploded perspective view of an ink jet head which is a liquid droplet discharging head of a first embodiment of the present invention.
Figure 2:
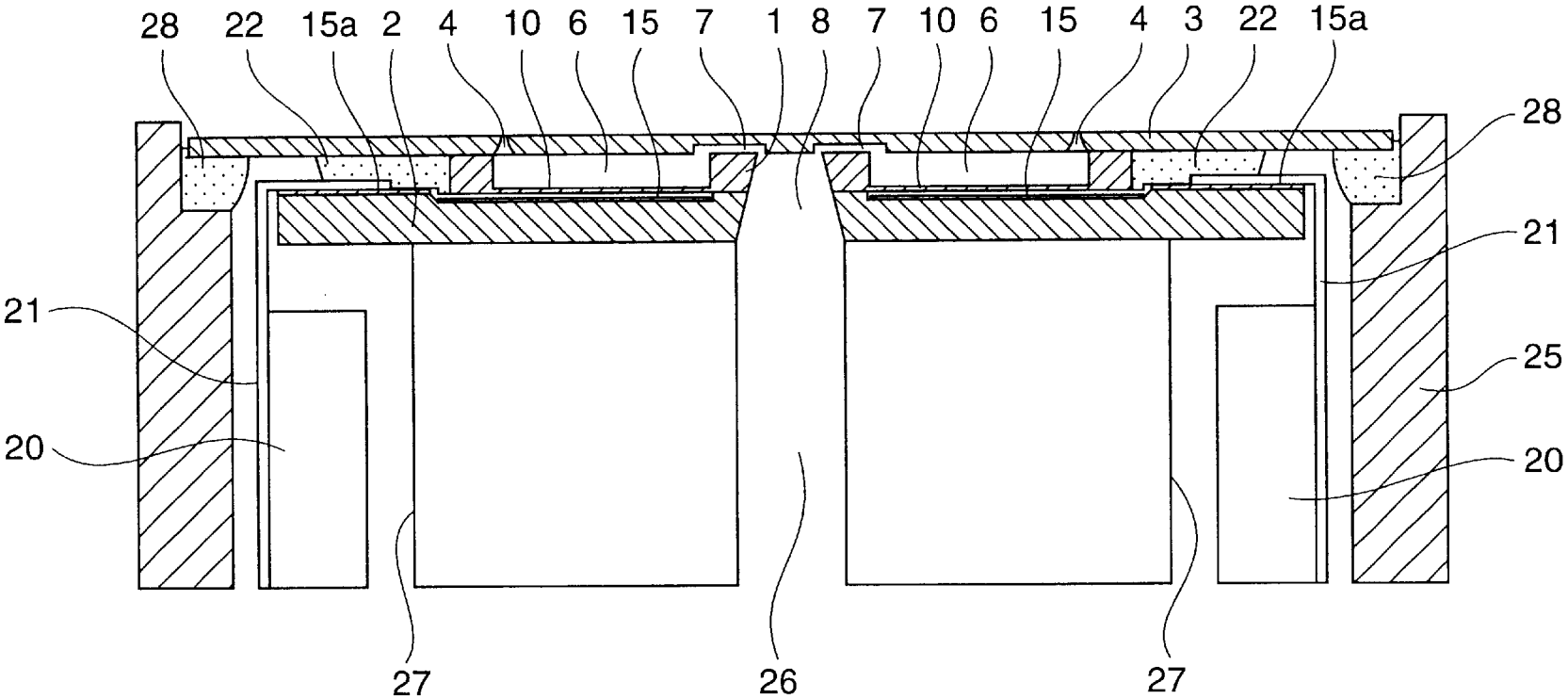
FIG. 2 is a sectional view of the ink jet head of FIG. 1, taken in the longitudinal direction of the diaphragm.
Figure 3:
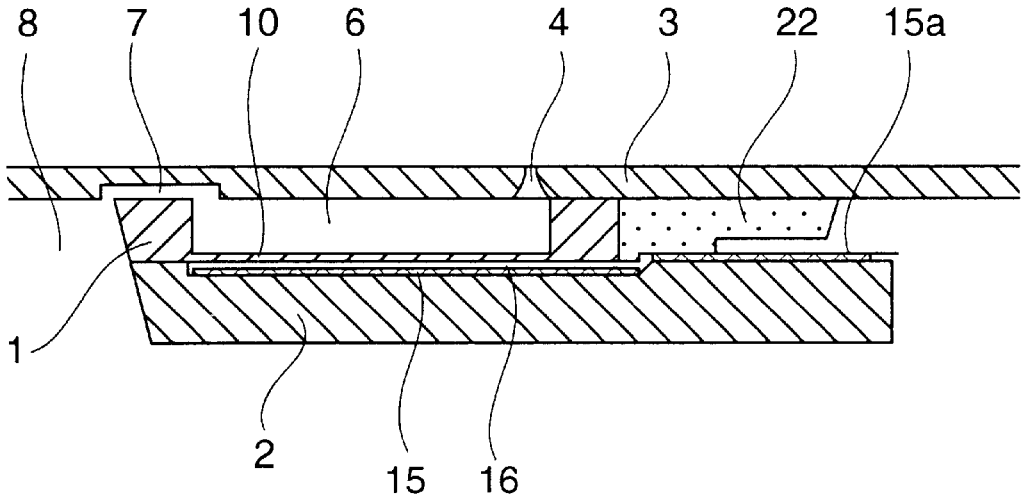
FIG. 3 is an enlarged view of the ink jet head of FIG. 2.
Figure 4:
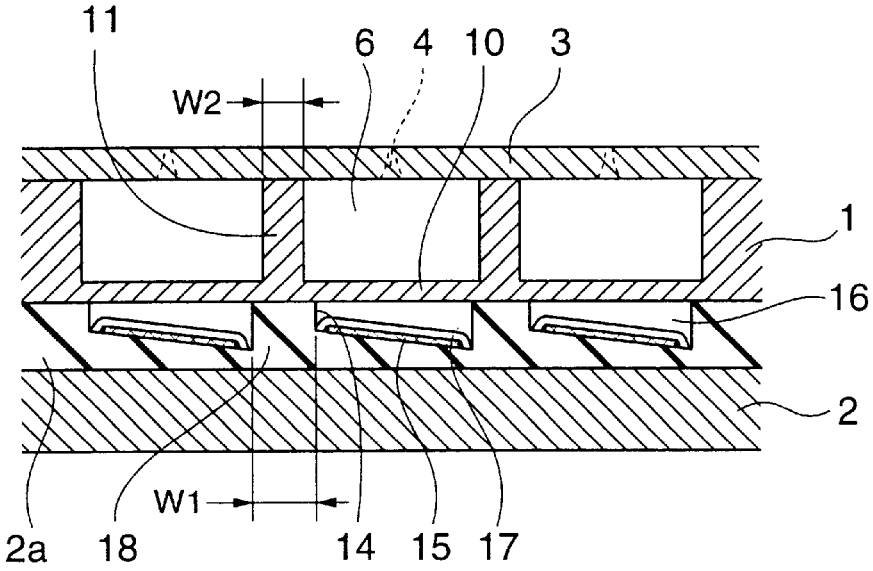
FIG. 4 is an enlarged sectional view of the ink jet head of FIG. 1, taken in the width direction of the diaphragm of the present invention.

As shown in FIG. 1, the ink jet head of the first embodiment of the present invention comprises: a diaphragm/liquid chamber substrate 1 that is a first substrate containing silicon, such as a monocrystal silicon substrate, a polycrystalline silicon substrate, or an SOI substrate; an electrode substrate 2 that is a second substrate made of silicon, Pyrex glass, or ceramics; and a nozzle plate 3 that is a third substrate disposed on the diaphragm/liquid chamber substrate 1. These substrates constitute a plurality of nozzles 4 for discharging ink droplets, discharging chambers 6 that are ink passages communicating with the nozzles 4, and a common liquid chamber 8 that communicates with the discharging chambers via a fluid resistivity unit 7 which also serves as an ink supply passage.

The diaphragm/liquid chamber substrate 1 is provided with a concave portion so as to form the discharging chambers 6 communicating with the nozzles 4 and a diaphragm 10 (also an electrode) which constitutes the bottom of the discharging chambers 6. The nozzle plate 3 is provided holes to be the nozzles 4 and grooves to form the fluid resistivity unit 7. Further, a penetrating portion is formed through the diaphragm/liquid chamber substrate 1 and the electrode substrate 2, so as to form a common liquid chamber 8.

If the diaphragm/liquid chamber substrate 1 is a monocrystal silicon substrate, a high-concentration boron layer to serve as an etching stopping layer is formed by injecting boron so as to have the same thickness as the diaphragm 10. The diaphragm/liquid chamber substrate 1 is then bonded to the electrode substrate 2. After that, the concave portion to be the discharging chambers 6 is subjected to anisotropic etching using an etching liquid such as a KOH aqueous solution. Here, the high-concentration boron layer serves as the etching stopping layer, thereby forming the diaphragm 10 with high precision. If the diaphragm 10 is formed by a polycrystalline silicon substrate, a polycrystalline silicon thin film to be the diaphragm 10 is formed on the liquid chamber substrate, or a polycrystalline silicon thin film is formed on the electrode substrate 2 flattened by a sacrificial material in advance. In the latter case, the sacrificial material is removed to complete the diaphragm 10.

An electrode film to be the first electrode may be formed on the diaphragm 10. In this embodiment, however, the diaphragm 10 also serves as the diaphragm 10 by dispersing impurities, as described above. An insulating film may be formed on a surface of the electrode substrate 2. As the insulating film, an oxide film such as an $SiO_2$ film or a nitride film such as an $Si_3N_4$ film can be used. The formation of the insulating film is carried out by a film forming technique in which the surface of the diaphragm is subjected to thermal oxidation to form an oxide film.

A p- or n-type monocrystal silicon substrate is used for the electrode substrate 2, and thermal oxidation is carried out to from an oxide layer 2*a*. Concave portions 14 are formed in the oxide layer 2*a*. On the bottom surface of each concave portion 14, electrodes 15 that face the diaphragm 10 are formed. A gap 16 is formed between the diaphragm 10 and the electrodes 15. The diaphragm 10 and the electrode constitute an actuator unit (an energy generating unit). Here, the depth of each concave portion 14 determines the length of the gap 16. Pyrex glass (boro-silicate glass) may be used for the electrode substrate 2. In this case, the electrode substrate 2 has insulating properties, and the concave portions 14 are directly formed. Further, a ceramics substrate may be used for the electrode substrate 2.

The section of each concave portion 14 of the electrode substrate 2 has an inclined surface in the width direction of the diaphragm 10. The electrodes 15 are formed on the bottom surface of the concave portion 14, so that the diaphragm faces the electrodes 15 in a non-parallel state in the width direction of the diaphragm 10. The gap 16 formed by the diaphragm 10 and the electrodes 15 in the non-parallel state is referred to as the "non-parallel gap". It should be understood that the diaphragm 10 and the electrodes 15 may also be situated in parallel to each other, or situated in non-parallel to each other in the longitudinal direction of the diaphragm 10.

The bonding width W1 of each partition wall 18 between the concave portions 14, which partition wall is the bonding portion between the diaphragm/liquid chamber substrate 1 and the electrode substrate 2, is in a range of 5 $\mu$m to 25 $\mu$m. If the width W1 of the bonding portion is smaller than 5 $\mu$m, the substrates 1 and 2 start starting from each other at the time of dicing. If the width W1 exceeds 25 $\mu$m, on the other hand, it is difficult to arrange nozzles at a discharging density of 300 dpi. Furthermore, the width W2 of each partition wall 19 between the discharging chambers 6 is narrower than the width 1 of each partition wall 18. In this structure, alignment errors caused at the time of substrate bonding can be absorbed, and the deformable area of the diaphragm can be prevented from decreasing.

A dielectric insulating film 17 made of an oxide film such as a $SiO_2$ film or a nitride film such as a $Si_3N_4$ film is formed on the surfaces of the electrodes 15. As mentioned before, it is also possible to form an insulating film on the diaphragm 10, instead of forming the insulating film 17 on the surfaces of the electrodes 15. Examples of the material used for the electrodes 15 on the electrode substrate 2 include gold, a metallic material, such as Al, Cr, or Ni, which is generally used in the formation of a semiconductor chip, a metallic material having a high melting point, such as Ti, TiN, or W, and a polycrystalline silicon material having a low resistivity with impurities.

In a case where the diaphragm/liquid chamber substrate 1 and the electrode substrate 2 are both silicon substrates, the substrates 1 and 2 can be bonded directly to each other. This direct bonding is performed at a temperature as high as 1000° C. It is also possible to form the electrode substrate 2 by silicon and perform anode bonding. In such a case, a Pyrex glass film is formed between the electrode substrate 2 and the diaphragm/liquid chamber substrate 1. The anode bonding may be performed via the Pyrex glass film. Also, if the diaphragm/liquid chamber substrate 1 and the electrode substrate 2 are silicon substrates, both substrates 1 and 2 can be bonded by eutectic bonding, with binder such as gold being interposed between the bonding surfaces.

In a case where the diaphragm/liquid chamber substrate 1 and the electrode substrate 2 are made of Pyrex glass, anode bonding can be performed. In such a case, a voltage of −300 V to −500 V is applied to the substrates 1 and 2, thereby performing a precise bonding operation at a relatively low temperature of 300° C. to 400° C.

In order to perform precise anode bonding, either the diaphragm/liquid chamber substrate (first substrate) 1 or the electrode substrate (second substrate) 2 needs to contain a large amount of alkali ions, so as to cause covalent binding between the first and second substrates on the bonding interfaces. Also, at the time of bonding, it is preferable to select materials having relatively similar thermal expansion coefficients so that thermal deformation between the substrates 1 and 2 can be restricted. In view of the above facts, the diaphragm/liquid chamber substrate 1 is formed by a monocrystal silicon substrate, and the electrode substrate 2 is formed by a Pyrex glass substrate (boro-silicate glass), so that thermal deformation between the substrates 1 and 2 can be restricted.

Besides the large number of nozzles 4, a groove portion for forming the fluid resistivity unit 7 that communicates with the common liquid chamber 8 and the discharging chambers 6 is also formed on the nozzle plate 3. A water-repellent covering film is formed on the ink discharging surface (i.e., on the outer surface of the nozzle plate 3). The nozzle plate 3 is formed by a stainless substrate. Other than that, a nickel plating film formed by an electroforming technique, a resin material such as polyimide processed by excimer laser, or a metal plate having through holes formed by a pressing process may be used as the nozzle plate 3.

The water-repellent film can be formed by electrolytic or non-electrolytic nickel eutectoid plating with fine particles of polytetrafluoroethylene (PTFE-Ni eutectoid plating).

The nozzles 4 are arranged in two rows, and the discharging chambers, the diaphragm 10, the electrodes 15 are also arranged in two rows. The common liquid chamber 8 is situated at the center of the nozzle rows so as to supply ink to the discharging chambers 6 arranged in the right and left rows. Thus, a multi-nozzle head having a simple head structure and yet containing a large number of nozzles can be obtained.

Each of the electrodes 15 extends outward to form a connecting portion 15*a* (an electrode pad), and an FPC cable 21 on which a driver IC 20 as a head driving circuit is mounted by wire bonding is connected to the connecting portion 15*a* via an anisotropic conductive film. Here, the electrode substrate 2 and the nozzle plate 3 (the inlet of the gap 16) are hermetically sealed by gap sealing agent 22 such as epoxy resin adhesive agent, thereby preventing the diaphragm 10 from being fixed by humidity entering into the gap 16.

Furthermore, the entire ink jet head is bonded onto a frame member 25 by adhesive agent. The frame member 25 has an ink supply opening 26 for supplying ink from the outside into the common liquid chamber 8 of the ink jet head. The FPC cable 21 and other parts are accommodated by holes 27 formed in the frame member 25.

The frame member 25 and the nozzle plate 3 are sealed by gap sealing agent 28 such as epoxy resin adhesive agent, thereby preventing ink remaining on the surface of the water-repellent nozzle plate 3 from reaching the electrode substrate 2 and the FPC cable 21.

The frame member 25 is jointed to a joint member 30 of an ink cartridge, so that ink can be supplied to the common liquid chamber 8 through the ink supply opening 26 from the ink cartridge via a filter 31 that is thermally fused to the frame member 25.

In the ink jet head having the above structure, the diaphragm 10 serves as the common electrode, and the electrodes 15 serve as the individual electrodes. A driving voltage is applied between the diaphragm 10 and the electrodes 15 to generate static electricity between the diaphragm 10 and the electrodes 15. At this point, the diaphragm 10 is deformed toward the electrodes 15. As a result, the content volume of the discharging chambers 6 are increased to lower the inner pressure. Thus, the ink enters into the discharging chambers 6 from the common liquid chamber 8 via the fluid resistivity unit 7.

When the voltage application to the electrodes 15 is stopped, the static electricity no longer acts on the diaphragm 10, which then returns to the original position by its own elasticity. As a result, the inner pressure of the discharging chambers 6 becomes higher to discharge ink droplets through the nozzles 4. When the voltage application is resumed, the diaphragm 10 is again drawn toward the electrodes 15 by static electricity.

In such a case, the displacement starts from a point where the effective gap length between the diaphragm 10 and the electrodes 15 (the length minus the thickness of the protection film 17) is shorter. As the displacement progresses, the gap length between the diaphragm 10 and the electrodes 15 becomes gradually shorter. Accordingly, the displacement starting point of the diaphragm can be steadied, and the driving voltage can be lowered.

Figure 5:
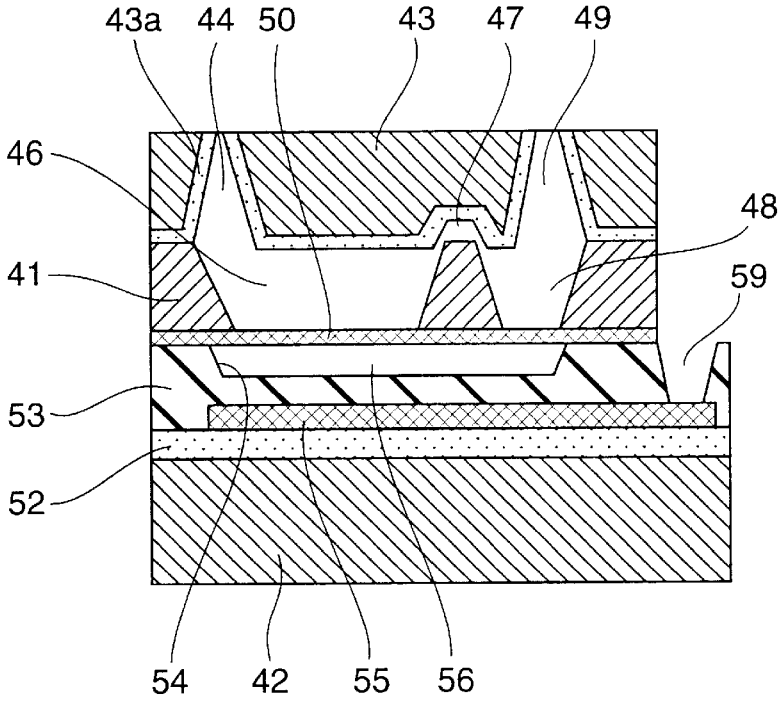
FIG. 5 is a sectional view of an ink jet head which is a liquid droplet discharging head of a second embodiment of the present invention, taken in the longitudinal direction of the diaphragm.
Figure 6:
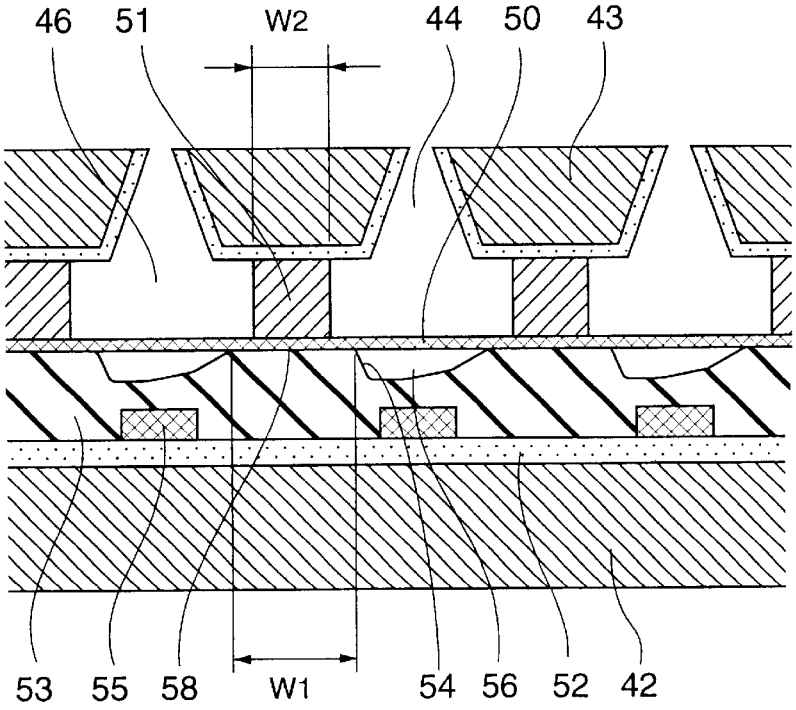
FIG. 6 is a sectional view of the ink jet head of FIG. 5, taken in the width direction of the diaphragm.
Figure 7:
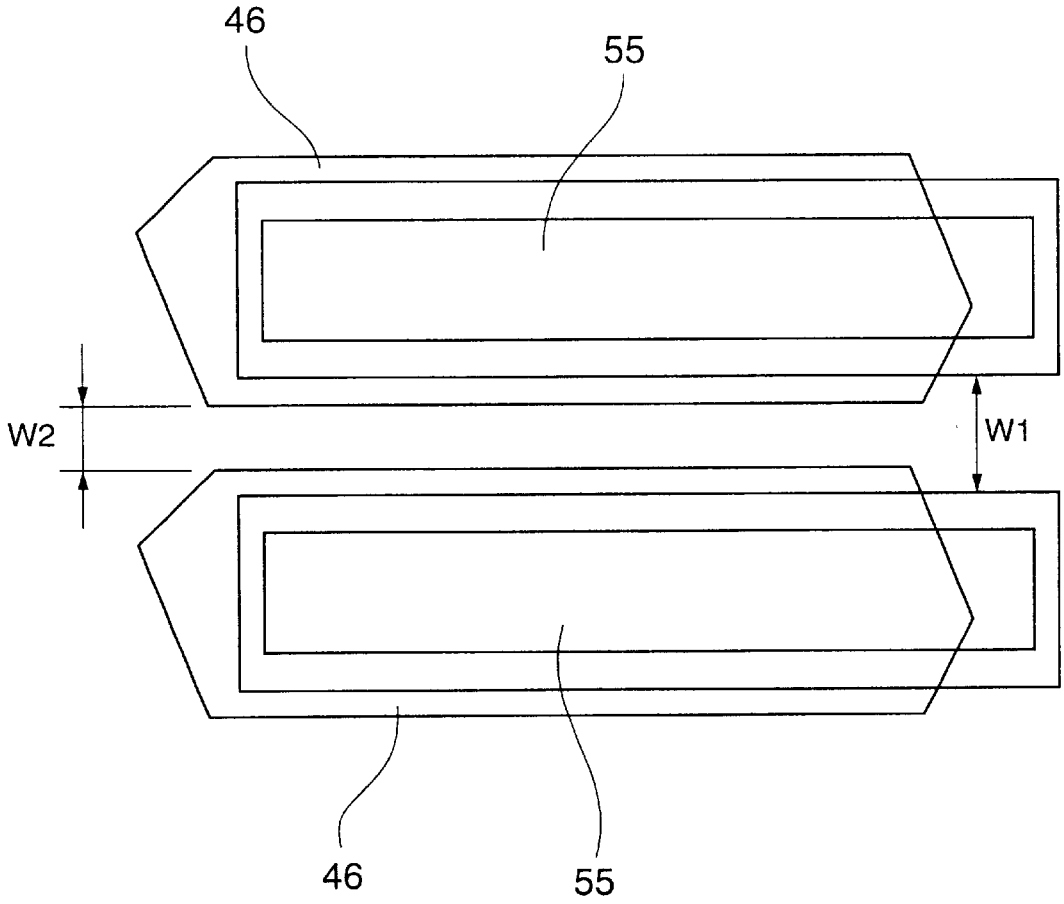
FIG. 7 is a plan view of the ink jet head of FIG. 5.

Referring now to FIGS. 5 to 7, an ink jet head in accordance with a second embodiment of the present invention will be described below. FIG. 5 is a sectional view of this ink jet head taken in the longitudinal direction of the diaphragm, and FIG. 6 is a sectional view of the ink jet head taken in the width direction of the diaphragm.

This ink jet head comprises a diaphragm/liquid chamber substrate 41 which serves as a first substrate, an electrode substrate 42 which serves as a second substrate disposed below the diaphragm/liquid chamber substrate 41, and a nozzle plate 43 which serve as a third substrate above the diaphragm/liquid chamber substrate 41. The nozzle plate 43 has a plurality of nozzles 44. Discharging chambers 46 that are ink fluid passages communicating with the respective nozzles 44 are formed in the diaphragm/liquid chamber substrate 41. This ink jet head further comprises a common liquid chamber 48 that communicates with each of the discharging chambers 46 via a fluid resistivity unit 47 which also serves as an ink supply passage.

The diaphragm/liquid chamber substrate 41 is provided with a concave portion that constitutes the discharging chambers 46 communicating with the nozzles 44, and also constitutes a diaphragm 50 (also an electrode) that is the bottom of the wall surfaces of the discharging chambers 46. The diaphragm/liquid chamber substrate 41 is provided with another concave portion that constitutes the common liquid chamber 48. The nozzle plate 43 is provided with holes to be nozzles 44, a groove to be the fluid resistivity unit 47, and an ink supply opening 49 for supplying ink from the outside into the common liquid chamber 48. An oxide film 43*a* is formed on the discharging chamber side of the nozzle plate 43.

A silicon oxide film 52 is formed on the electrode substrate 42, and electrodes 55 are formed on the surface of the silicon oxide film 52. The electrodes 55 face the diaphragm 50. Another silicon oxide film 53 is deposited on the silicon oxide film 52 and the electrodes 55, and concave portions 54 that create non-parallel gaps 56 between the diaphragm 50 and the electrodes 55 are formed in the silicon oxide film 53. The bottom surface of each of the concave portions 54 is not situated in parallel with the diaphragm 50 at the section in the width direction, thereby creating the non-parallel gap 56.

The upper surface of the partition wall 58 between each two concave portions 54 is bonded to the diaphragm/liquid chamber substrate 41, and the width W1 of the bonding portion is in the range of 5 $\mu$m to 25 $\mu$m. As in the first embodiment of the present invention, the width W2 of the partition wall 51 between each two discharging chambers 46 is narrower than the width W1 of the bonding portion of each partition wall 58. Further, an opening 59 is formed in the silicon oxide film 53 at an outer portion from the diaphragm/liquid chamber substrate 51. The opening 59 serves as an electrode retrieving portion for connecting the electrodes 55 to an external circuit.

Referring now to FIGS. 8A to 11C, the production method of the ink jet head of the second embodiment of the present invention will be described below. FIGS. 8A to 8D and 9A to 9C illustrate the ink jet head in production processes, taken in the width direction of the diaphragm. FIGS. 10A to 10D and 11A to 11C illustrate the ink jet head in the production processes, taken in the longitudinal direction of the diaphragm. Except in the final process, the same components as in FIGS. 5 to 7 are denoted by the same reference numerals.

Figure 8A:
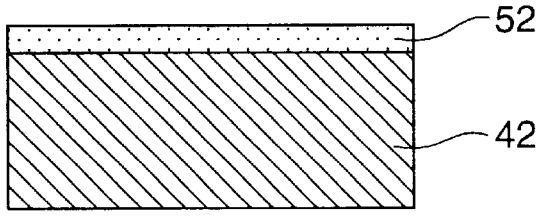
FIGS. 8A to 8D illustrate production processes of the ink jet head of FIG. 5, taken in the width direction of the diaphragm.
Figure 10A:
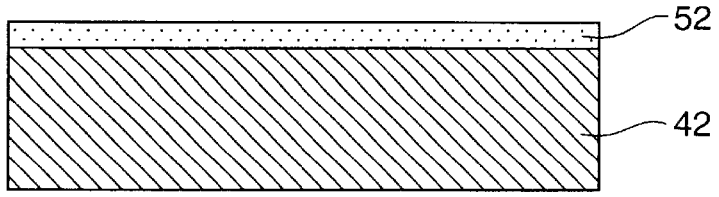
FIGS. 10A to 10D illustrate production processes of the ink jet head of FIG. 5, taken in the longitudinal direction of the diaphragm.

As shown in FIGS. 8A and 10A, the silicon oxide film 52 having a thickness of approximately 1 $\mu$m is formed by wet or dry thermal oxidation process performed on the silicon substrate 42. The silicon substrate 42 is a p-type monocrystal silicon commercially available having a low resistivity, and has (110) or (100) orientation. The silicon substrate 42 serves as an electrode substrate, while the silicon oxide film 52 serves as a protection film. Although a p-type monocrystal silicon substrate is used in this embodiment, an n-type substrate may be employed.

Figure 8B:
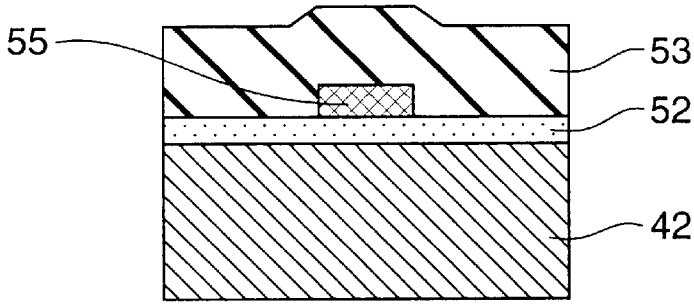
Figure 10B:
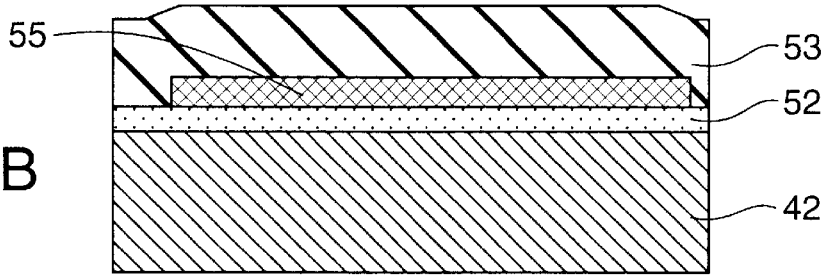

As shown in FIGS. 8B and 10B, a polycrystalline silicon film having a thickness of approximately 300 nm is deposited and then processed by photo-etching to form the electrodes 55. The polycrystalline silicon film is doped with impurities so as to function as an electrode material. Although polycrystalline silicon doped with impurities is used as electrodes in this embodiment, a refractory metallic material, such as tungsten, may be used. Also, electrodes made of conductive ceramics, such as titanium nitride, can achieve the same effects.

Figure 8C:
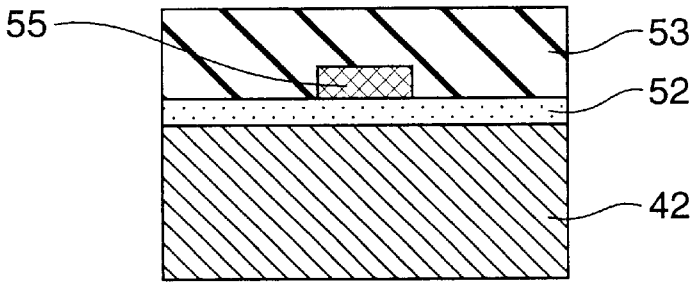
Figure 8D:
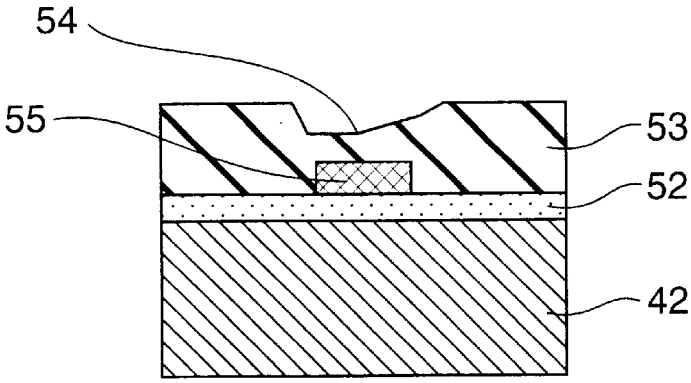
Figure 10C:
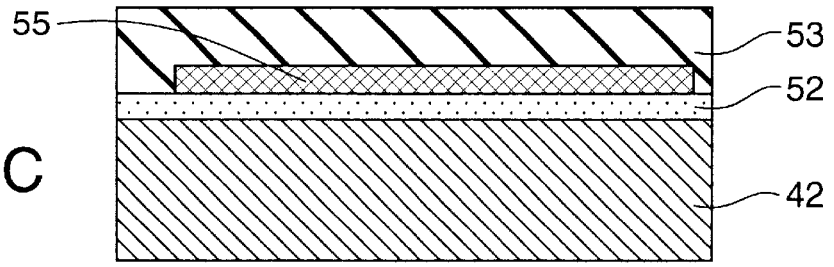
Figure 10D:
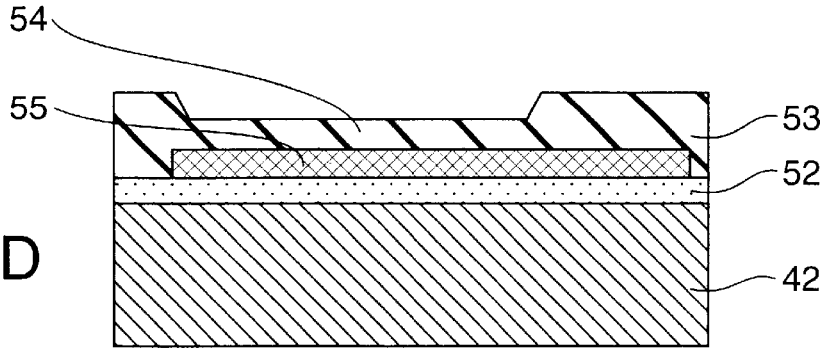

A silicon oxide film is deposited on the entire surface by a CVD technique or the like so as to form the silicon oxide film 53 to be an electrode protection film and a gap formation region. Here, the silicon oxide film 53 may include impurities such as boron and phosphorus. With those impurities, direct bonding can be achieved at a relatively low temperature. After that, the surface of the silicon oxide film 34 is planarized by a thermal annealing process, as shown in FIGS. 8C and 10C.

A photoresist is then applied onto the silicon oxide film 53 and patterned to form a resist pattern exposing pat in which a gap is formed. With the photoresist pattern being used as a mask, the concave portions 54 are formed in the silicon oxide film 53, using a hydrogen fluoride solution including a buffering component such as ammonium fluoride (BHF-63U: trade name, produced by Daikin Industries, Ltd.). Here, the depth of each concave portion 54 is as small as 1 $\mu$m. Accordingly, the variation in the depth in the silicon oxide film 53 can be made very small in the concave portion formation by wet etching using a hydrogen fluoride solution. A groove formation technique by dry etching using a plasma etching device can also be employed. In this embodiment, gradual changes are made to the photoresist pattern, thereby obtaining a non-parallel shape. Thus, a driving operation at a low voltage can be performed.

Referring now to FIGS. 9A to 9C and 11A to 11C, the production processes of the diaphragm/liquid chamber substrate will be described below. The silicon substrate used for the diaphragm/liquid chamber substrate has a p-type polarity, and the (110) orientated silicon substrate 41, which is polished on one side, is employed. With this silicon substrate, the anisotropy of the etching rate in a wet etching process is utilized to perform the desired accurate shaping process.

Figure 9A:
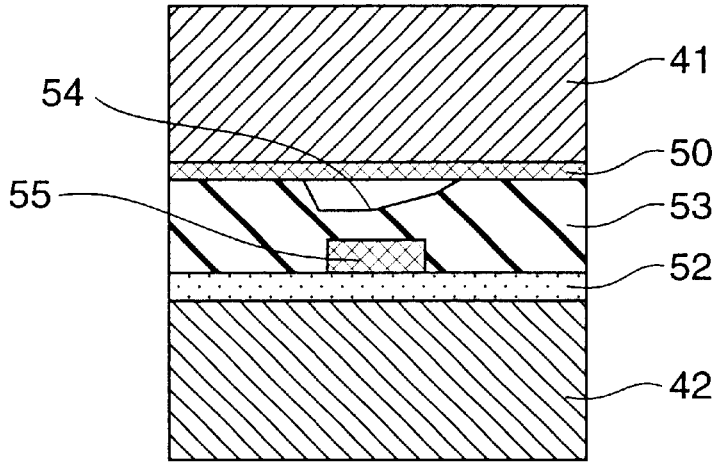
FIGS. 9A to 9C illustrate production processes of the ink jet head of FIG. 5, taken in the width direction of the diaphragm.
Figure 11A:
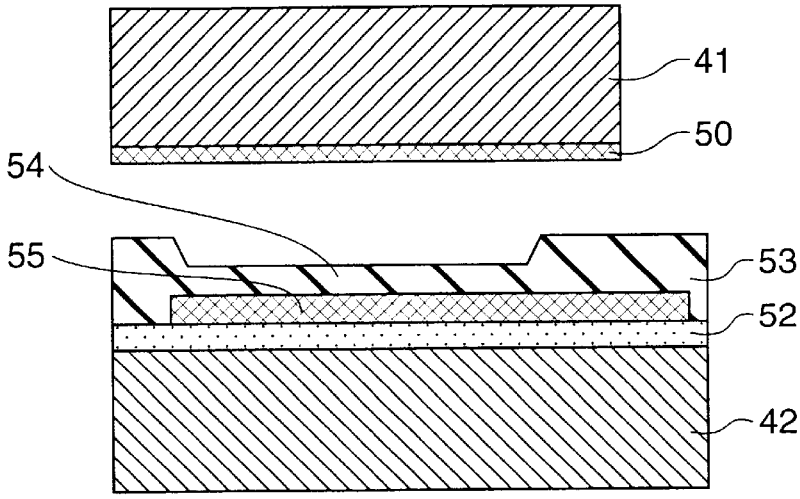
FIGS. 11A to 11C illustrate production processes of the ink jet head of FIG. 5, taken in the longitudinal direction of the diaphragm.

High-concentration boron is applied to the bonding surface of the silicon substrate 41 with the silicon substrate 42, which is the electrode substrate. The high-concentration boron is then activated by thermal diffusion process to a carrier density of $5\times10^{19}$ atoms/cm$^3$ or more, and diffused to a predetermined depth (equivalent to the thickness of the diaphragm 50), thereby forming the high-concentration impurity diffusion layer, which is the diaphragm 50, as shown in FIGS. 9A and 11A. Although a silicon substrate containing impurities at a high concentration is used in this embodiment, it is also possible to employ an activation layer of an SOI (Silicon On Insulator) substrate for the diaphragm 50. The epitaxial layer of substrate formed by silicon epitaxial growth on the high-concentration impurity substrate may also serve as the diaphragm 50. As shown in FIG. 11A, the length of the silicon substrate 41 in the longitudinal direction of the diaphragm is smaller than the silicon substrate 42, thereby forming an electrode retrieving region.

Figure 9B:
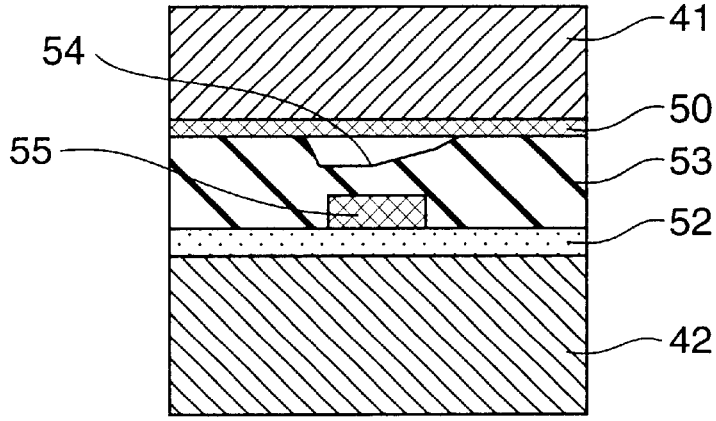
Figure 11B:
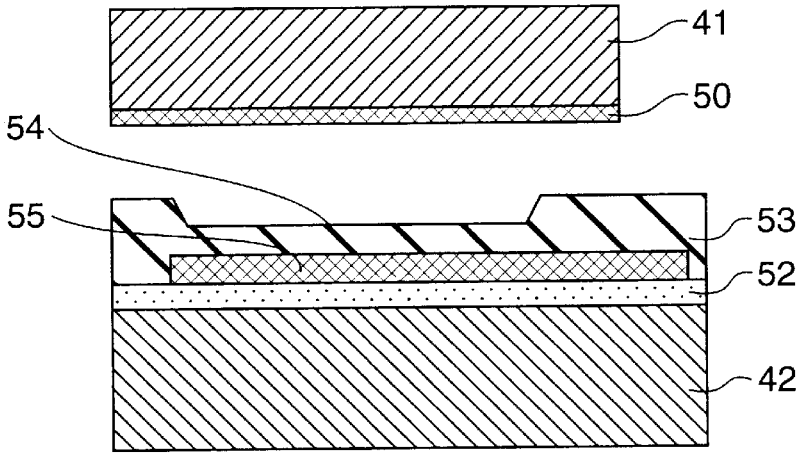

As shown in FIGS. 9B and 11B, the silicon substrate 41 and the silicon substrate 42 are bonded to each other. First, the silicon substrates 41 and 42 are washed by a substrate washing technique that is known for RCA washing, and then immersed in a heated solution of sulfuric acid and a hydrogen peroxide solution, thereby preparing the bonding surfaces to have a hydrophilic nature. The wetted bonding surface thus processed facilitates direct bonding. The two substrates 41 and 42 are gently aligned with each other, and then bonded to each other. After the alignment, the two substrates 41 and 42 are introduced into a vacuum chamber which is reduced to a pressure level of $1\times10^{-3}$ mbar or lower. With the alignment of the substrates 41 and 42 being maintained, both wafers are pressed to complete pre-bonding. The pressing force should be small enough not to deform the substrates or misalignment of the substrates. In an atmosphere of nitrogen gas, the bonded wafers are baked at 800° C. for two hours, thereby achieving firm bonding.

After the bonding, to make the height of the liquid chamber smaller than the initial thickness of the wafer (silicon substrate 41), a polishing or grinding or CMP process is performed to reduce the thickness of wafer. Even when the thickness of the wafer is reduced by the mechanical, physical, or chemical process, the interface bonded by the direct bonding is not removed or damaged. Since the width of the bonding surfaces is 10 $\mu$m in this embodiment, the wafers can be prevented from having cracks chipping and exfoliation. More specifically, commercially-available silicon wafers each having a thickness of 400 $\mu$m are bonded to each other, and the silicon substrate 41 is polished until the height of the liquid chamber becomes 95±5 $\mu$m.

The silicon substrate 41 is heated to form a buffer oxide film having a thickness of approximately 50 nm. After the formation of the buffer oxide film, a silicon nitride film to be an etching barrier layer having a thickness of approximately 100 nm is formed by a CVD technique or the like. Patterning is carried out to form the liquid chambers by a photo-etching method. With a photoresist film being used as a mask, a silicon nitride film and silicon oxide film are etched in this order, thereby forming a pattern having opening regions that constitute the discharging chambers and the common liquid chamber.

Figure 9C:
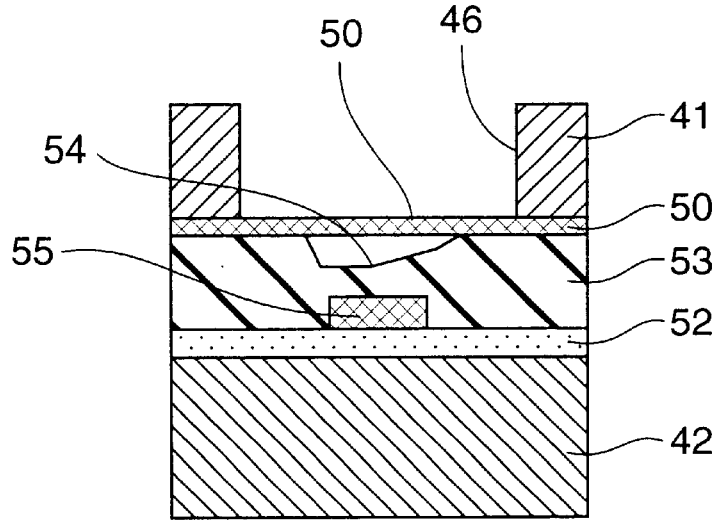
Figure 11C:
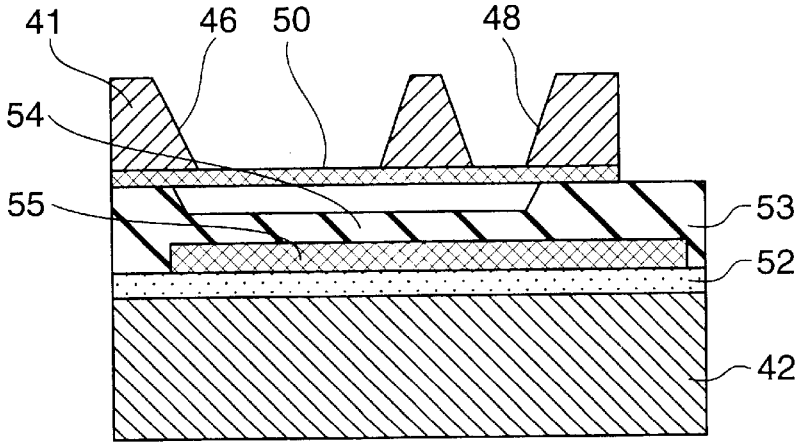

The silicon substrate 41, to which the silicon substrate 42 is already bonded, is then immersed in a high-concentration potassium hydroxide (for instance, a 30% KOH aqueous solution containing a buffer component (alcohol-containing agent in this embodiment) heated to 80° C.). Silicon anisotropic etching is then carried out, so that the concave portions to be the discharging chambers 46 and the common liquid chamber 48 can be formed, and that the diaphragm 50 constituted by the high-concentration impurities diffusion layer can be formed on the bottom surfaces of the discharging chambers 46, as shown in FIGS. 9C and 11C.

In this case, when the etching liquid reaches the high-concentration impurities diffusion layer, the etching rate drastically drops. As a result, the etching process automatically stops, thereby completing the diaphragm 50. Although the etching is performed using a high-concentration alkali metal aqueous solution in this embodiment, it is also possible to perform wet etching using TMAH (tetra-methyl-ammonium-hydroxide). After the etching, the diaphragm 50 is rinsed with ultra-pure water for approximately 10 minutes, followed by spin drying process.

As shown in FIG. 5, an opening 59 is then formed at a region for retrieving each electrode on the side of the silicon substrate 42, which is the electrode substrate. The entire surface, except for the opening 59, is covered with metallic mask, and the silicon oxide film 53 remaining in the electrode retrieving region is removed by a plasma etching device. The gap portion is then sealed with resin so as to block foreign matters and water (not shown).

The nozzle plate (top plate) 43 having the nozzles 44, the fluid resistivity unit 47, and the ink supply opening is bonded onto the diaphragm/liquid chamber substrate 41 by adhesive agent, thereby completing an ink jet head. Although the silicon substrate is employed as the nozzle plate in this embodiment, a separate nozzle plate that is formed into a desired nozzle shape may be used. Finally, the ink jet head is cut into chips by a dicing saw, and a connecting FPC is connected to the chips.

Figure 12:
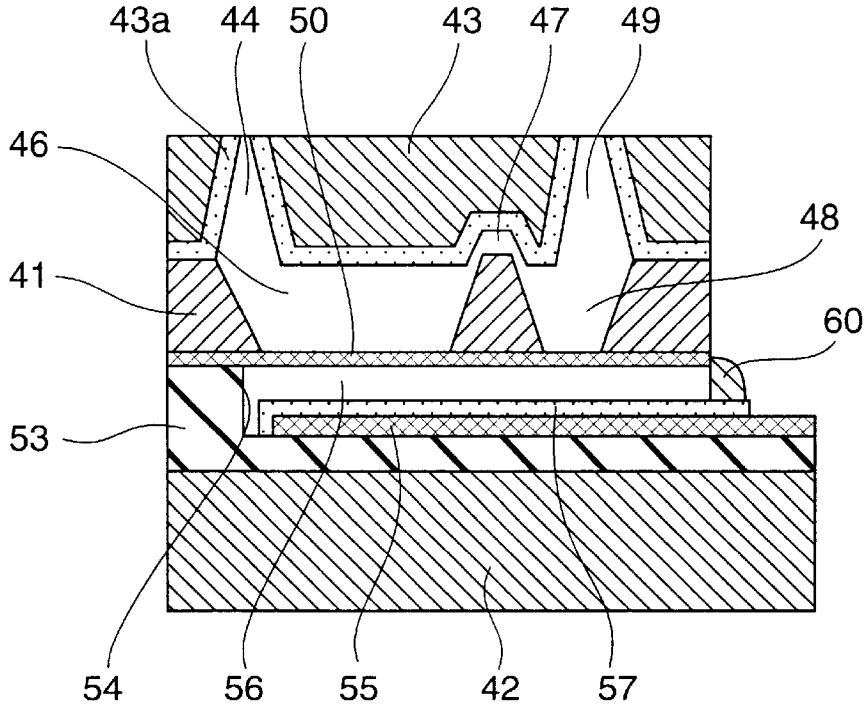
FIG. 12 is a sectional view of an ink jet head which is a liquid droplet discharging head of a third embodiment of the present invention, taken in the longitudinal direction of the diaphragm.
Figure 13:
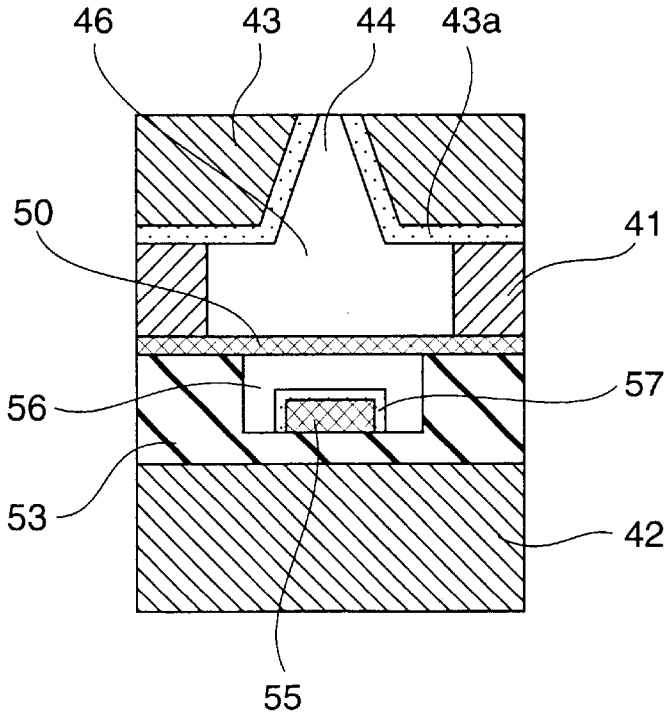
FIG. 13 is a sectional view of the ink jet head of FIG. 12, taken in the width direction of the diaphragm.

Referring now to FIGS. 12 and 13, an ink jet head in accordance with a third embodiment of the present invention will be described below. FIG. 12 is a sectional view of this ink jet head, taken in the longitudinal direction of the diaphragm. FIG. 13 is a sectional view of this ink jet head, taken in the width direction of the diaphragm.

The ink jet head of this embodiment differs from the ink jet head of the second embodiment in the structure of the electrode substrate side. More specifically, the silicon oxide film 53 is formed on the electrode substrate 42, and the gap portions 54 each having a bottom surface in parallel with the diaphragm 50 are formed in the silicon oxide film 53. The electrodes 55 are formed on the bottom surfaces of the concave portions 54, so that the diaphragm 50 is situated in parallel with the electrodes 55. The gaps 56 formed between the diaphragm 50 and the electrodes 55 are referred to as "parallel gaps". Also, an insulating film 57 is formed on the surface of each electrode 55. In this embodiment, the opening formed by each concave portion 54 is sealed by sealing agent 60.

Referring now to FIGS. 14A to 17C, the production method of the ink jet head of the third embodiment of the present invention will be described below. FIGS. 14A to 15C illustrate production processes of the ink jet head, taken in the width direction of the diaphragm. FIGS. 16A to 17C illustrate the production processes of the ink jet head, taken in the longitudinal direction of the diaphragm. Except in the final process, the same components as in FIGS. 12 and 13 are denoted by the same reference numerals.

Figure 14A:
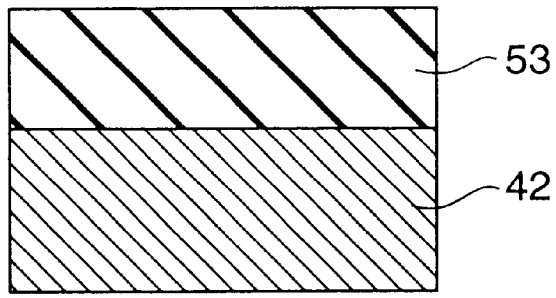
FIGS. 14A to 14C illustrate production processes of the ink jet head of FIG. 12, taken in the width direction of the diaphragm.
Figure 16A:
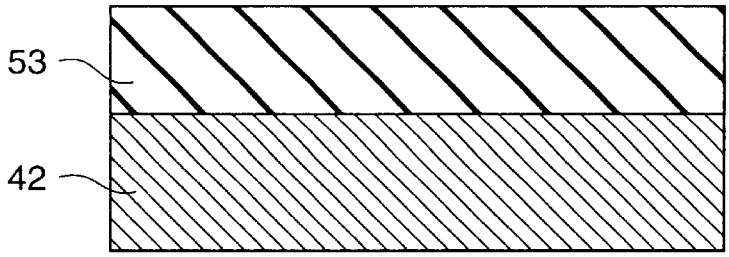
FIGS. 16A to 16C illustrate production processes of the ink jet head of FIG. 12, taken in the longitudinal direction of the diaphragm.

A shown in FIGS. 14A and 16A, the silicon oxide film 53 having a thickness of approximately 2 $\mu$m is formed on the silicon substrate 42 by a wet or dry thermal oxidation technique. The silicon substrate 42 is a p-type monocrystal silicon substrate that is commercially available as a low-resistance product, and (110) or (100) orientated. The silicon substrate 42 serves as an electrode substrate, and the silicon oxide film 53 serves as a protection film. Although a p-type monocrystal silicon substrate is used in this embodiment because of its reasonable price, an n-type substrate may be used as the silicon substrate 42.

Figure 14B:
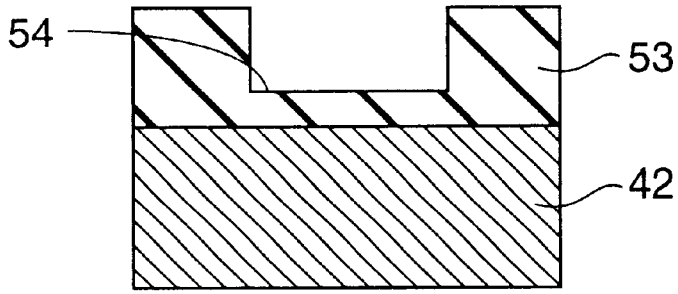
Figure 16B:
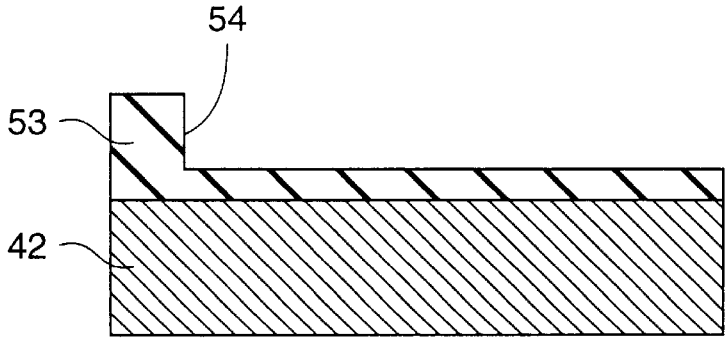

Photoresist is then applied to the wafer (silicon substrate 42), and patterning is carried out so as to form electrodes. Adjacent electrodes are separated from each other, and the bonding surface portion (the separation wall 58) with the diaphragm/liquid chamber substrate 41 is made 25 μm wide. With the photoresist pattern being used as a mask, the concave portion 54 to be electrode formation grooves are formed in the silicon oxide film 53, as shown in FIGS. 14B and 16B, using a hydrogen fluoride aqueous solution containing a buffer component such as ammonium fluoride (for instance, BHF-63U, produced by Daikin Industries, Ltd.).

The depth of each concave portion 54 is equivalent to the total thickness of the electrode material and the space required to be maintained between the diaphragm and the electrodes. The depth is as small as 1 μm, the variation of the depth in the wafer can be very small in the wet etching process using a hydrogen fluoride aqueous solution. A groove formation method by dry etching using a plasma etching device may also be employed.

Figure 14C:
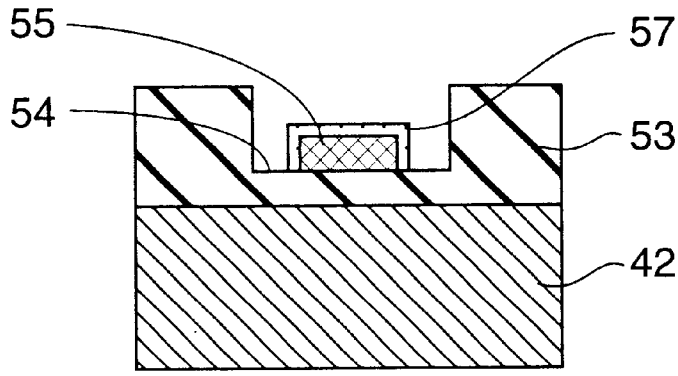
Figure 15A:
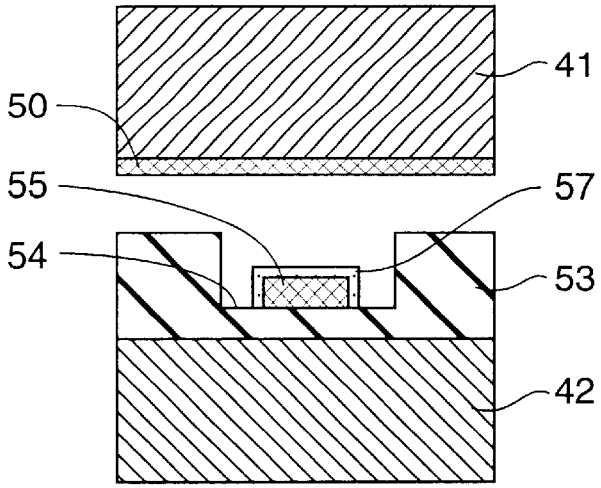
FIG. 15A to 15C illustrate production processes of the ink jet head of FIG. 12, taken in the width direction of the diaphragm.
Figure 15B:
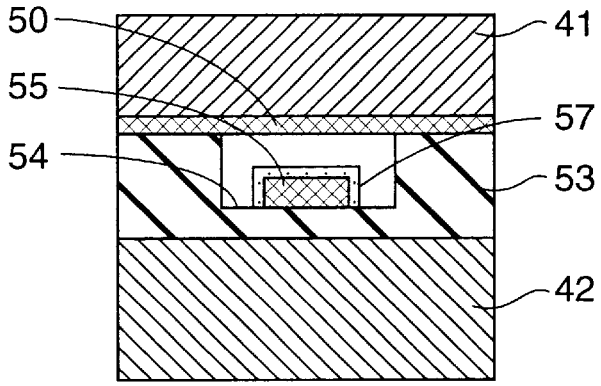
Figure 15C:
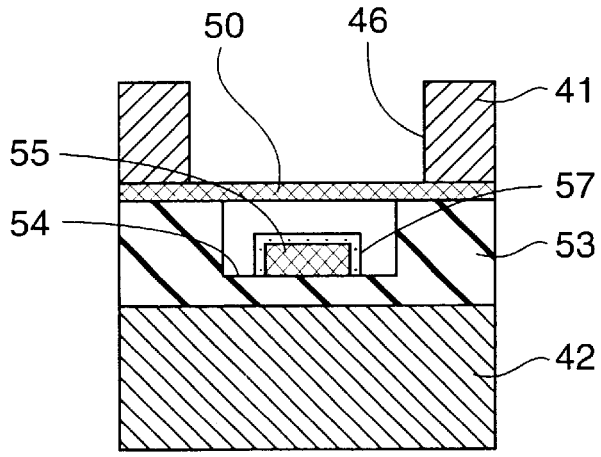
Figure 16C:
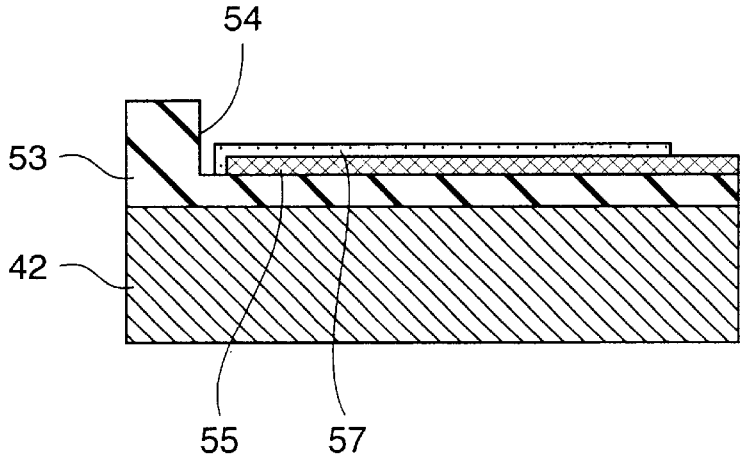
Figure 17A:
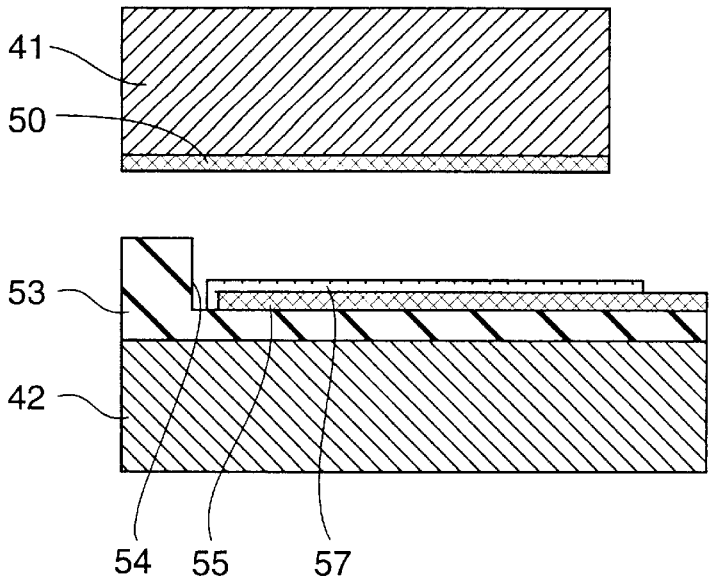
FIGS. 17A to 17C illustrate production processes of the ink jet head of FIG. 12, taken in the longitudinal direction of the diaphragm.
Figure 17B:
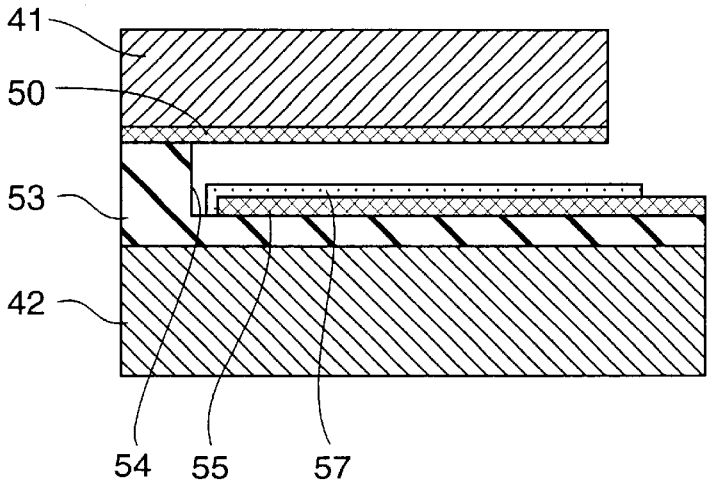
Figure 17C:
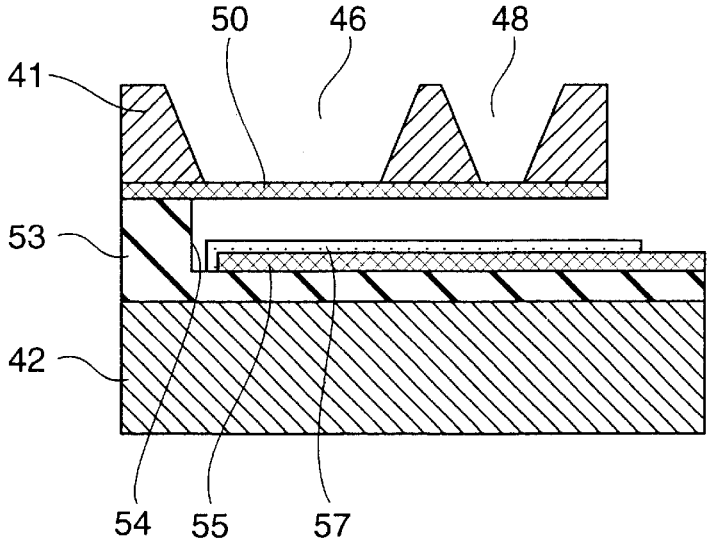

After the photoresists is removed, polycrystalline silicon doped with impurities to be the electrode material and having approximately 300 nm is deposited, and formed into a desired electrode shape by photo-etching, thereby obtaining the electrodes 55, as shown in FIGS. 14C and 16C. Although polycrystalline silicon doped with impurities is used as the electrodes 55, a metallic material having a high fusing point such as tungsten may be used for the electrodes 55. Also, electrodes made of conductive ceramics such as titanium nitride can achieve the same effects.

As shown in FIGS. 15A to 15C and 17A to 17C, the silicon substrate 41 is bonded to the silicon substrate 42, and the concave portions to be the discharging chambers 46 are formed by anisotropic etching, with the high-concentration impurities diffusion layer being used as an etching stopping layer. After the diaphragm 50 is formed, the nozzle plate 43 is bonded to the diaphragm/liquid chamber substrate 41.

Figure 18:
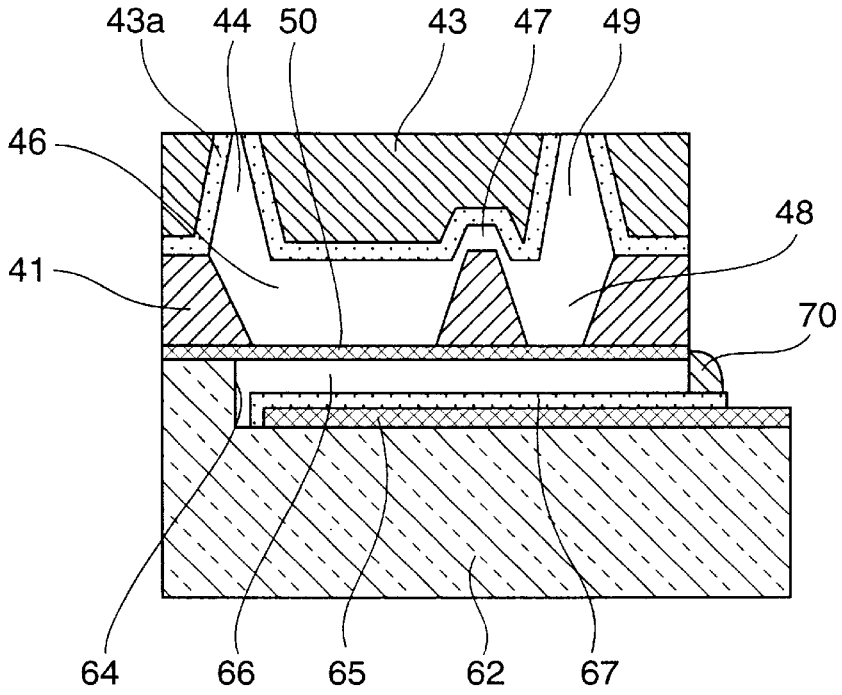
FIG. 18 is a sectional view of an ink jet head which is a liquid droplet discharging head of a fourth embodiment of the present invention, taken in the longitudinal direction of the diaphragm.
Figure 19:
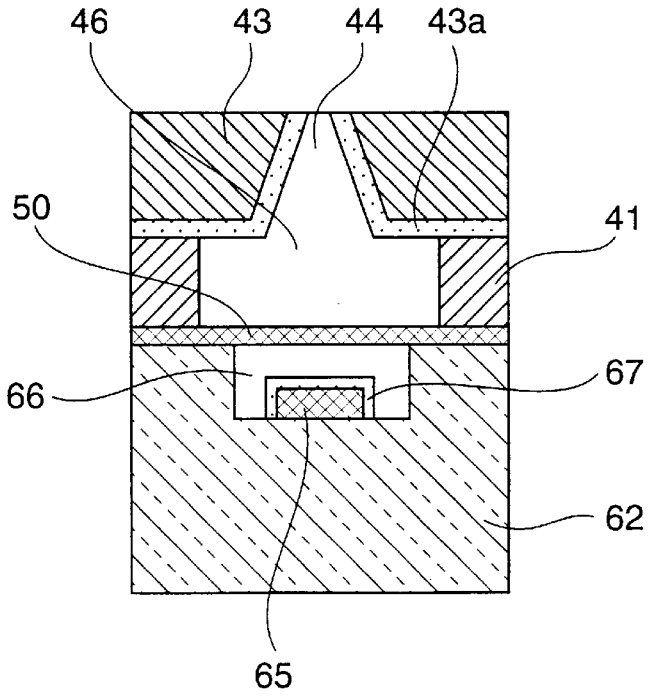
FIG. 19 is a sectional view of the ink jet head of FIG. 18, taken in the width direction of the diaphragm.

Referring now to FIGS. 18 and 19, an ink jet head of a fourth embodiment of the present invention will be described below. FIG. 18 is a sectional view of this ink jet head, taken in the longitudinal direction of the diaphragm. FIG. 19 is a sectional view of the ink jet head, taken in the width direction of the diaphragm.

This ink jet head has the same structure as the ink jet head of the third embodiment of the present invention, except that the structure of the electrode substrate and the bonding state between the electrode substrate and the diaphragm/liquid chamber substrate. More specifically, an electrode 62 is made of Pyrex glass (boro-silicate glass), and concave portions 64 are formed in the electrode substrate 62. The bottom surface of each of the concave portions 64 is in parallel with the diaphragm 50. An electrode 65 that faces the diaphragm 50 is formed on the bottom surface of each of the concave portions 64, so that the diaphragm 50 can be situated in parallel with the electrodes 65. The insulating film 57 is formed on the surface of each of the electrodes 65. As in the foregoing embodiments, opening gaps 66 formed by the concave portions 64 are sealed by sealing agent 70. The electrode substrate 62 and the diaphragm/liquid chamber substrate 41 are bonded to each other by anode bonding.

Referring now to FIGS. 20A to 24C, the production processes of the ink jet head of the fourth embodiment will be described below. FIGS. 20A to 20C and 21A to 21C illustrate the production processes of the ink jet head, taken in the width direction of the diaphragm. FIGS. 22A to 22C and 23A to 23C illustrate the production processes of the ink jet head, taken in the longitudinal direction of the diaphragm. Except in the final process, the same components as in FIGS. 18 and 19 are denoted by the same reference numerals.

Figure 20A:
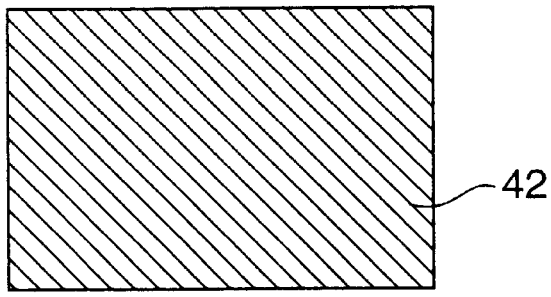
FIGS. 20A to 20C illustrate production processes of the ink jet head of FIG. 18, taken in the width direction of the diaphragm.
Figure 22A:
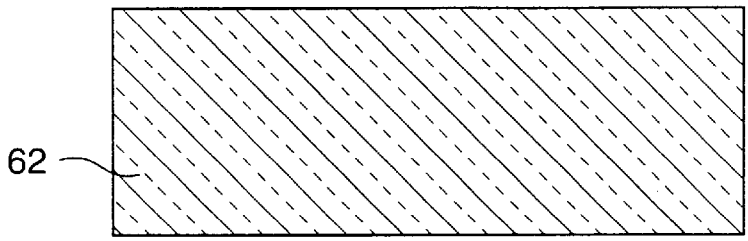
FIGS. 22A to 22C illustrate production processes of the ink jet head of FIG. 18, taken in the longitudinal direction of the diaphragm.

As shown in FIGS. 20A and 22A, the boro-silicate glass 61 (for instance, 7750: produced by Corning Company Ltd., trade name) to be the electrode substrate having both surfaces polished at high precision is used.

Figure 20B:
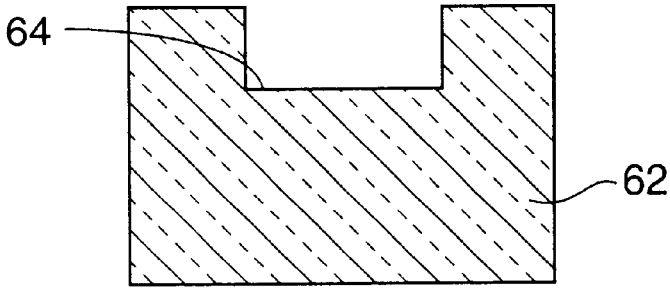
Figure 20C:
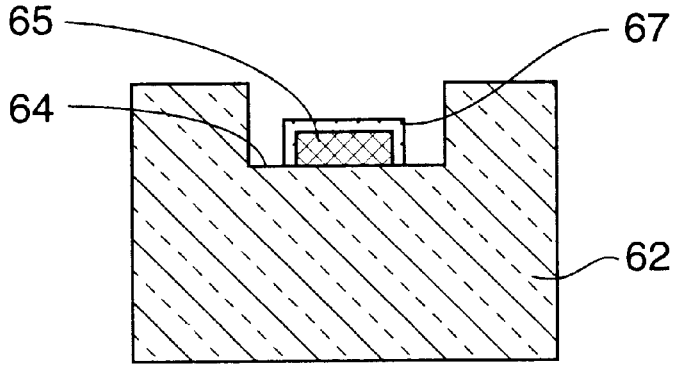
Figure 21A:
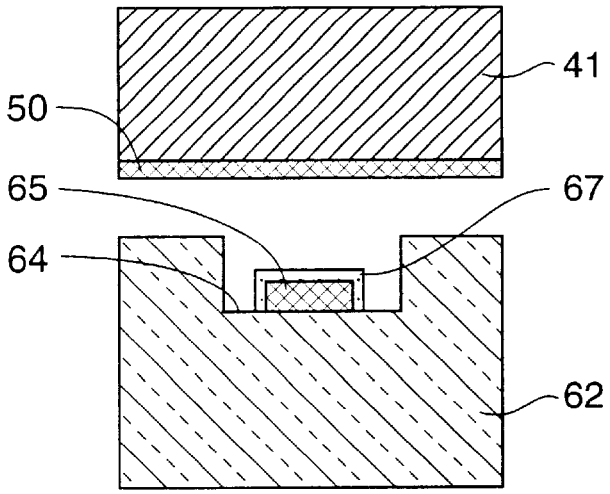
FIGS. 21A to 21C illustrate production processes of the ink jet head of FIG. 18, taken in the width direction of the diaphragm.
Figure 21B:
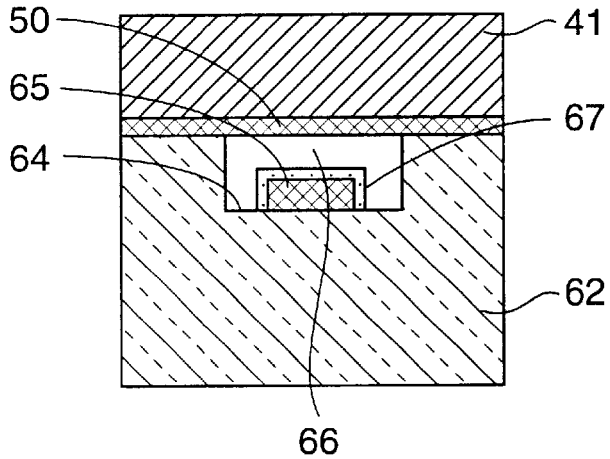
Figure 21C:
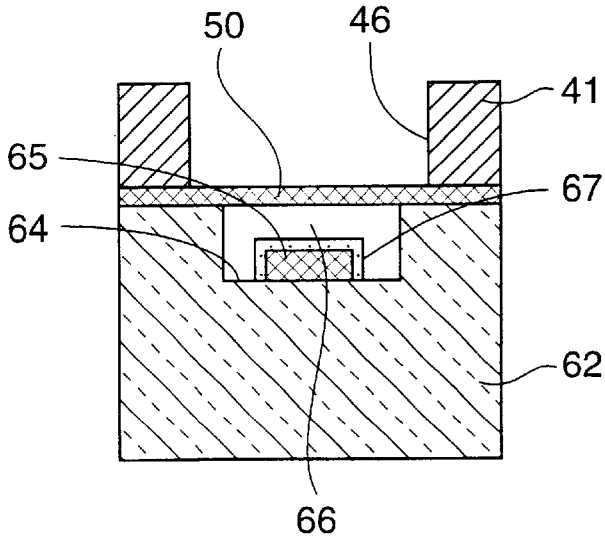
Figure 22B:
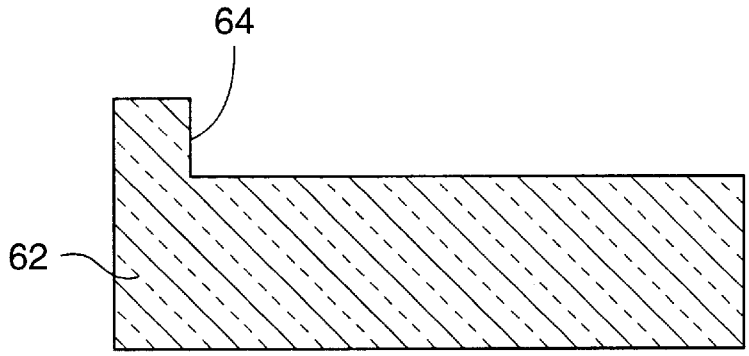
Figure 22C:
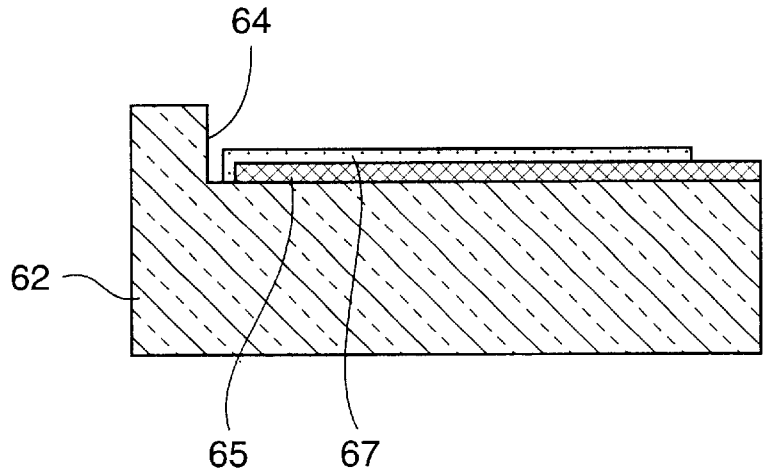
Figure 23A:
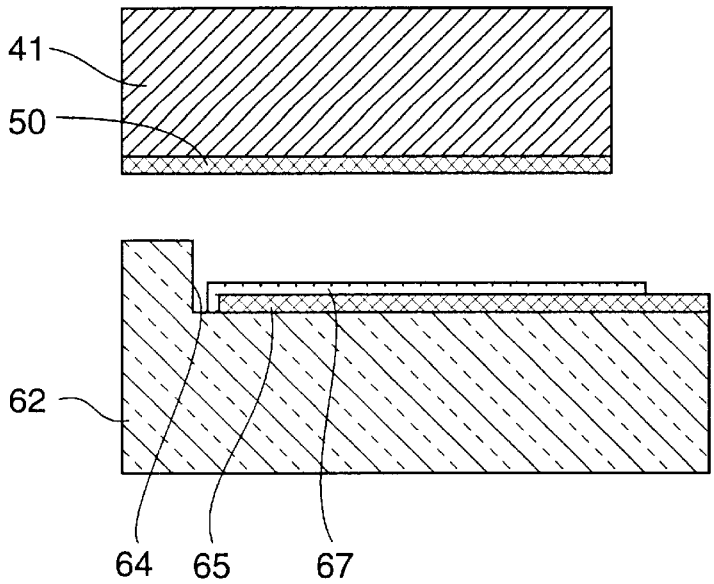
FIGS. 23A to 23C illustrate production processes of the ink jet head of FIG. 18, taken in the longitudinal direction of the diaphragm.
Figure 23B:
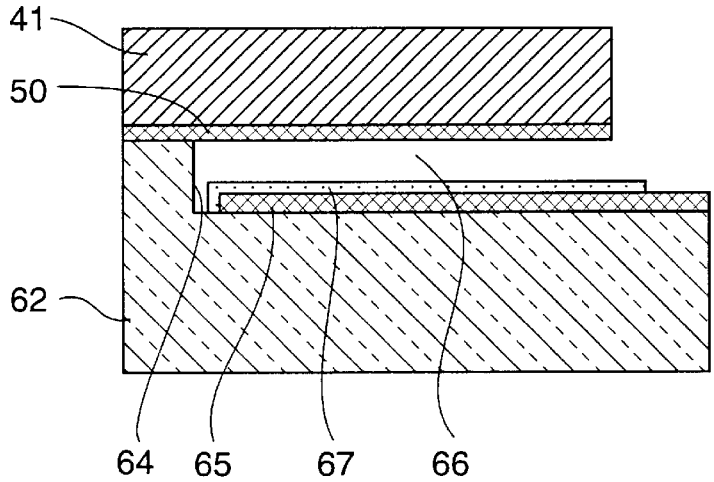
Figure 23C:
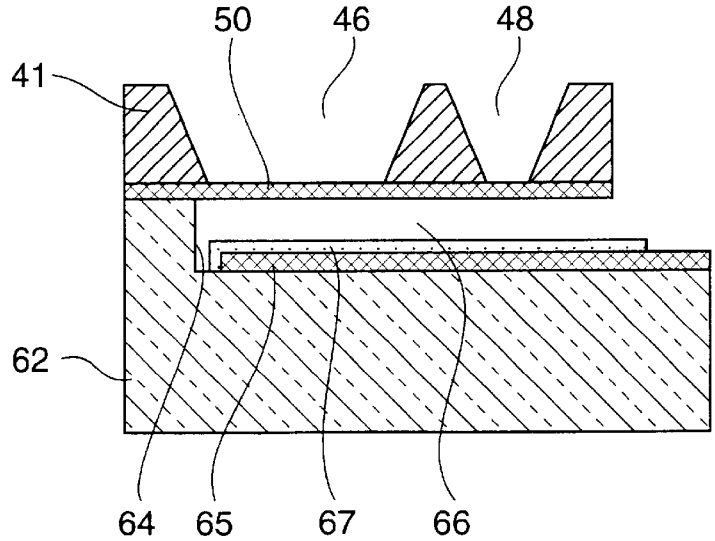

Photoresist is then applied to the boro-silicate glass 61, and patterning is carried out to form the electrodes. Here, adjacent electrodes are separated, and the bonding surface with the diaphragm substrate has a width of 25 μm. With the photoresist pattern being used as a mask, the concave portions 64 to be the electrode formation grooves are formed in the boro-silicate glass 61, as shown in FIGS. 20B and 22B, using a hydrogen fluoride aqueous solution containing a buffer component such as ammonium fluoride (for instance, BHF-63U: trade name, produced by Daikin Industries, Ltd.).

The depth of each of the concave portions 64 is equivalent to the total thickness of the electrode material and the space required between the diaphragm and the electrodes. At this point, the depth of each of the concave portions 64 is as small as 1 μm. Even through it is difficult to perform an accurate three-dimensional etching process on a glass substrate, the variation of the depth in the boro-silicate glass surface can be reduced by a wet etching process using a hydrogen fluoride aqueous solution. A groove forming technique by dry etching using a plasma etching device or the like can be applied.

After the photoresist is removed, a metallic material (a nickel alloy in this embodiment) to be the electrodes 65 is deposited, and an electrode pattern is formed by etching.

The silicon substrate 41 is then gently placed and bonded onto the electrode substrate 62, and heated to 400° C. A positive voltage is then applied to the silicon substrate 41, and a positive voltage is applied to the boro-silicate glass 61, thereby performing an anode bonding process. Although a constant voltage of 500 V is applied in this embodiment, a pulse-like voltage may be applied. When the current reaches its peak, the current is maintained at its peak for 10 minutes. The voltage application is then stopped, and the substrates are cooled down, thereby completing the bonding. The bonding progress can be observed through the boro-silicate glass surface.

As shown in FIGS. 21A to 21C and 23A to 23C, anisotropic etching is carried out to from the concave portions which are the discharging chambers 46, with the high-concentration impurities diffusion layer of the silicon substrate 41 being used as an etching stopping layer. After the diaphragm 50 is formed, the nozzle plate 43 is bonded to the silicon substrate 41.

Evaluation tests were carried out on the width of the gap wall, which is the bonding portion between the substrate provided with ah diaphragm and the substrate provided with the electrodes in the above ink jet head of the present invention.

To measure the effective bonding strength of the electrode substrate and the diaphragm/liquid chamber substrate, the sizes of the two substrates correspond to the size of the ink jet head to be actually used. Four types of ink jet heads were prepared for the tests. The bonding width W1 between adjacent bits was 20 μm, 10 μm, 5 μm, and 3 μm. The ratio of the bonding width (bonding portion) between adjacent bits to the electrode formation portion (the concave portions, i.e., the non-bonding portion) of each ink jet head was made constant, so that the bonding area of each ink jet head became the same. Each electrode substrate was formed so that bonding conditions and other conditions became the same among the ink jet heads. Evaluations were then made on the bonding strength to measure the rigidity of each of the ink jet heads.

After the formation of the electrode substrate, a silicon wafer that forms the diaphragm was aligned with and bonded to the electrode substrate. The bonded substrates were baked at 1000° C. for two hours, thereby producing actuators constituted by the directly bonded electrode substrate and the diaphragm/liquid chamber substrate. In the ink jet head production method described earlier in this specification, the processes for forming the liquid chambers and bonding the nozzle plate are normally performed. However, no liquid chambers were formed in this test so as to evaluate the bonding properties.

After the bonding of the two substrates, a ultrasonic detector imaging apparatus was used to detect a void (i.e., a non-bonded area due to foreign matters) and its location on the bonding surface. When secure bonding was confirmed, the wafers were cut into chips by a dicing saw, and tests were conducted on the shape and the bonding strength of each ink jet head. The bonding strength was evaluated by the tensile strength using a tensile tester. The results are shown in Table 1.

TABLE 1

| bonding width | 3 μm | 5 μm | 10 μm | 20 μm |
|---|---|---|---|---|
| ultrasonic flow detecting image | ○ | ○ | ○ | ○ |
| dicing result | exfoliation occurred | ○ | ○ | ○ |
| tensile strength* | 3 kgf | 35 kgf | 50 kgf | 50 kgf |

*tensile strength: kgf per chip

As can be seen from Table 1, the chip having a bonding width of 3 μm showed no strength in practical use, as a part of the ink jet head was removed from the bonding surface at the time of chip cutting by the dicing saw. Accordingly, it was found that the bonding width needs to be 5 μm or larger. Meanwhile, in an ink jet head having a discharging density of 300 dpi or higher, the intervals between adjacent bits was approximately 85 μm. Since the diaphragm needs to have a width of approximately 60 μm, the width of each partition wall between bits becomes approximately 25 μm. In view of this, the bonding width of the gap wall between the electrode substrate and the diaphragm substrate should be in the range of 5 μm to 25 μm. In this structure, ink jet heads each having enough bonding strength and a discharging density higher than 300 dpi can be effectively produced.

In the next test, after the formation of the electrode substrate, the silicon wafer that forms the diaphragm was aligned to and bonded to the electrode substrate. The bonded substrates were anode-bonded to each other with a voltage of 500 V at 400° C., thereby forming actuators. As in the previous test, no liquid chambers were formed to evaluate the bonding properties. After the bonding of the two substrates, the bonding surface was observed through the glass surface to detect a void (i.e., a non-bonded area due to foreign matters) and its location on the bonding surface. After secure bonding was confirmed, the wafers were cut into ink jet heads by a dicing saw. A test on the bonding strength was then conducted on each of the ink jet heads. The bonding strength was evaluated by the tensile strength using a tensile tester. The results are shown in Table 2.

TABLE 2

| bonding width | 3 μm | 5 μm | 10 μm | 20 μm |
|---|---|---|---|---|
| current at the time of bonding | short-circuiting | varied | ○ | ○ |
| back surface observed | bonding uneven | ○ | ○ | ○ |
| dicing result | exfoliation occurred | ○ | ○ | ○ |
| tensile strength* | 10 kgf | 50 kgf | 50 kgf | 50 kgf |

*tensile strength: kgf per chip

As can be seen from Table 2, the chip having the bonding width of 3 μm showed no practical strength, as a part of the ink jet head came off the bonding surface at the time of chip cutting by the dicing saw. Accordingly, the bonding width needs to be 5 μm or larger. Meanwhile, to obtain an ink jet head having a discharging density of 300 dpi or higher, each gap between adjacent bits was approximately 85 μm. Since the diaphragm needs to have a width of approximately 60 μm for discharging ink droplets, the width of each partition wall between adjacent bits becomes approximately 25 μm. In view of this, the bonding with of the gap wall between the electrode substrate and the diaphragm substrate should be in a range of 5 μm to 25 μm. In this structure, ink jet heads each having enough bonding strength and a discharging density higher than 300 dpi can be effectively produced.

Next, evaluations were also made on the relationship between the width W1 of the bonding portion and the width W2 of each discharging partition wall. Here, ink jet heads were produced from an actuator unit having the bonding width W1 of 20 μm. For this evaluation test, an ink jet head having the discharging partition wall width W2 larger than the bonding width W1 (W2>W1), an ink jet head having the width W2 equal to the width W1 (W2=W1), and an ink jet head having the width W2 smaller than the width W1 (W2<W1) were prepared. Crosstalk was then evaluated between adjacent bits.

In the crosstalk evaluation test, a designated bit was driven by various driving methods, and the vibration of the ink surfaces of adjacent nozzles was measured by a CCD camera equipped with an enlargement lens. When the vibration displacement was in a non-discharging state, it was determined that no crosstalk occurred.

In accordance with the evaluation results, when the width W2 of each discharging chamber partition wall is larger than the bonding width W1, the vibration of the ink liquid surfaces of the bits adjacent to the driving bit was large, and crosstalk occurred. On the other hand, in a case where the discharging chamber partition wall was smaller than the bonding width W1, crosstalk scarcely occurred. A thinner partition wall naturally has lower rigidity, and it is therefore preferable that the thickness of the silicon diaphragm be 5 μm or larger.

Figure 24:
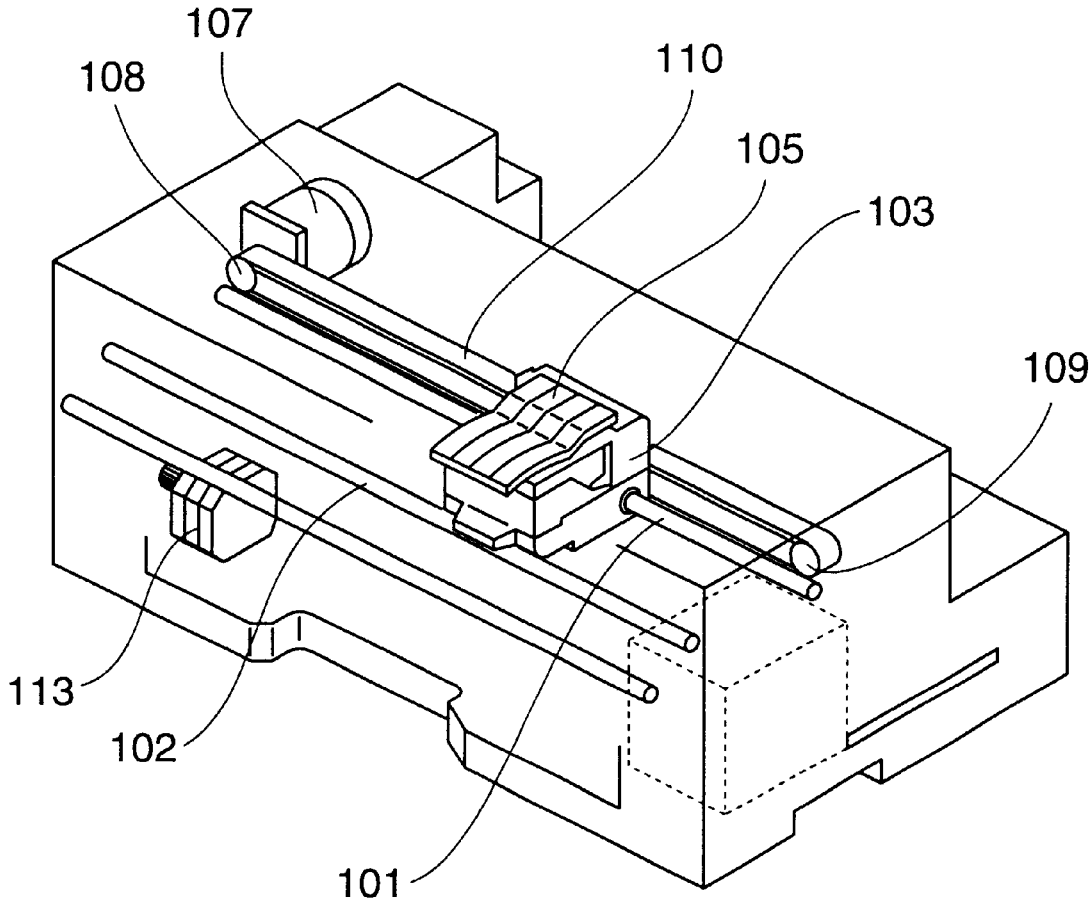
FIG. 24 is a perspective view of an ink jet recording device of the present invention.
Figure 25:
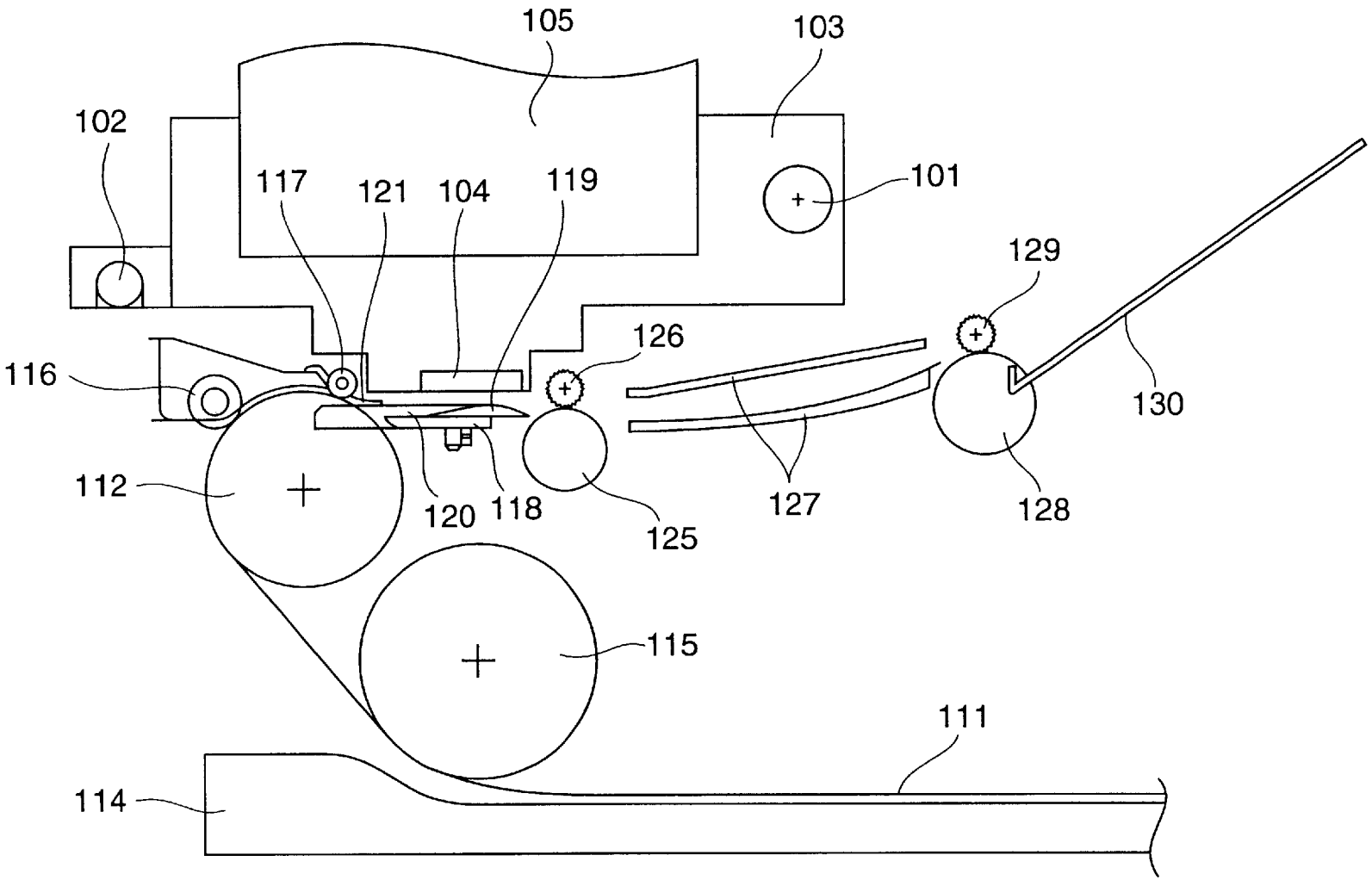
FIG. 25 shows the structure of the ink jet recording device of FIG. 24.

Referring now to FIGS. 24 and 25, an ink jet recording device on which the ink jet head of the present invention is mounted will be described.

This recording device has a main support guide rod 101 and a sub support guide rod 102 that bridge the side plates and are situated substantially in parallel with each other. The main support guide rod 101 and the sub support guide rod 102 slidably support a carriage 103 in the main scanning direction. An ink jet head 104 of the present invention, which discharges yellow ink, magenta ink, cyan ink, black ink, is mounted on the lower surface of the carriage 103, with its discharging surface (i.e., the nozzle surface) facing downward. The An exchangeable color ink cartridge 105 for supplying color ink to the head 104 is mounted on the upper surface of the carriage 103.

The ink jet head 104 may be constituted by a plurality of heads that separately discharge ink droplets of each color, or may be formed by one head having a plurality of nozzles that separately discharge ink droplets of each color.

The carriage 103 is jointed to a timing belt 110 tensioned between a driving pulley (driving timing pulley) 108 rotated by a main scanning motor 107 and an idler pulley 109. The main scanning motor 107 is controlled so that the carriage 103 moves and scans in the main scanning direction.

As shown in FIG. 25, a transportation roller 112 for feeding a paper sheet 111 between side plates (not shown) in a sub scanning direction that is perpendicular to the main scanning direction is rotatably supported. The transportation roller 112 receives the rotation of a sub scanning motor 13 shown in FIG. 24 through a row of gears (not shown). The transportation roller 112 inverts and transports the paper sheet 111 set in a sheet feeder cassette 114 and fed by the sheet feeding roller 115.

A pressure roller 116 for turning (inverting) the paper sheet 111 along the surface of the transportation roller 112, and a top roller 117 that serves as a holding roller are rotatably arranged o the circumferential surface of the transportation roller 112. An image receiving member 118 that guides the paper sheet 111 transported from the transportation roller 112 toward the head 104 is disposed on the downstream side of the transportation roller 112.

The image recording member 118 has a length equivalent to the movement range of the carriage 103 in the main scanning direction imaging area, and is provided with a large number of ribs 119 and 120 at predetermined intervals in the main scanning direction. The paper sheet 111 is brought into contact with and guided along the upper most surfaces of the ribs 119 and 120, thereby defining the gap between the head 104 and the imaging surface of the paper sheet 111.

At a location corresponding to the ribs 120 on the upstream side of the image receiving member 18, a sheet holding member 121 formed by a torsion spring as an elastic member is pressed toward the robs 120 and rotatably attached to the support axis of the top roller 117, which is a holding roller.

The downstream side of the image receiving member 118 includes a first sheet discharging roller 125 rotated to send the paper sheet 111 in the sheet discharging direction, an accelerating roller 126 that is in contact with the first sheet discharging roller 125, a transportation passage forming member 127, a second sheet discharging roller 128, and an accelerating roller 129 that is in contact with the second sheet discharging roller 128. A sheet discharging tray 130 for storing discharged paper sheets is attached obliquely to the device.

In this ink jet recording device, the sheet feeding roller 115 feeds the paper sheet 111 from the cassette 114, and the paper sheet 111 is inverted by the pressure roller 116. The paper sheet is then held by the top roller 117 and transported from the transportation roller 112 toward the image receiving member 118, which defines the gap between the paper sheet 111 and the head 104. The head 104 discharges ink droplets to form an image on the paper sheet 111 by an interlacing printing technique, for instance. The paper sheet 111 is then discharged onto the sheet discharging tray 130.

In the above embodiments, the present invention is applied to the ink jet heads of a side shooter type in which the diaphragm displacement direction corresponds to the ink discharging direction. However, it is also possible to apply the present invention to ink jet heads of an edge shooter type in which the diaphragm displacement direction is perpendicular to the ink discharging direction. The present invention can further be applied to liquid droplet discharging heads which discharge liquid resist or the like. Although the diaphragm and the liquid chambers are formed from one substrate in the above embodiments, they may be formed by separate substrates and bonded to each other.

The present invention is not limited to the specifically disclosed embodiments, but variations and modifications may be made without departing from the scope of the present invention.

The present invention is based on Japanese patent application No. 2000-083553 filed on Mar. 24, 2000, the entire contents of which are hereby incorporated by reference.

What is claimed is:

1. A liquid droplet discharging head comprising:

nozzles for discharging liquid droplets;

discharging chambers that communicates with the nozzles;

a diaphragm that provides walls for the discharging chambers;

a diaphragm substrate on which the diaphragm is disposed;

electrodes that face the diaphragm; and an electrode substrate on which the electrodes are disposed, the diaphragm substrate and the electrode substrate being bonded to each other at a plurality of bonding portions each corresponding to one of the electrodes, wherein the diaphragm is deformed by static electricity so as to discharge liquid droplets, and a bonding width of each bonding portion being in a range from 5 $\mu$m to 25 $\mu$m.

2. The liquid droplet discharging heat as claimed in claim 1, wherein the diaphragm substrate and the electrode substrate are silicon substrates, and bonded directly to each other.

3. The liquid droplet discharging head as claimed in claim 1, wherein the diaphragm substrate is a silicon substrate, the electrode substrate is a glass substrate, and the diaphragm substrate and the electrode substrate are bonded to each other by anode bonding.

4. The liquid droplet discharging head as claimed in claim 1, wherein each partition wall between the discharging chambers is narrower than the bonding portion.

5. The liquid droplet discharging head as claimed in claim 1, wherein the diaphragm is not in parallel with the electrodes in a width direction of the diaphragm.

6. The liquid droplet discharging head as claimed in claim 1, said liquid droplet discharging head has a discharging density of 300 dpi or higher.

7. An ink jet recording device on which an ink jet head is mounted, said ink jet head comprising:

nozzles for discharging liquid droplets;

discharging chambers that communicates with the nozzles;

a diaphragm that provides walls for the discharging chambers;

a diaphragm substrate on which the diaphragm is disposed;

electrodes that face the diaphragm; and an electrode substrate on which the electrodes are disposed, the diaphragm substrate and the electrode substrate being bonded to each other at a plurality of bonding portions each corresponding to one of the electrodes, wherein the diaphragm is deformed by static electricity so as to discharge liquid droplets, and a bonding width of each bonding portion between the diaphragm substrate and the electrode substrate is in a range from 5 $\mu$m to 25 $\mu$m.

* * * * *